US009239536B2

(12) United States Patent
Takezawa

(10) Patent No.: US 9,239,536 B2
(45) Date of Patent: Jan. 19, 2016

(54) IMAGE FORMING APPARATUS WITH ELECTROPHOTOGRAPHIC SYSTEM

(71) Applicant: CANON KABUSHIKI KAISHA, Tokyo (JP)

(72) Inventor: Satoru Takezawa, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/299,216

(22) Filed: Jun. 9, 2014

(65) Prior Publication Data

US 2014/0362154 A1 Dec. 11, 2014

(30) Foreign Application Priority Data

Jun. 11, 2013 (JP) ..... 2013-122703

(51) Int. Cl.
*G03G 15/043* (2006.01)

(52) U.S. Cl.
CPC ..... *G03G 15/043* (2013.01); *G03G 2215/0125* (2013.01)

(58) Field of Classification Search
CPC ..... G03G 15/043; G03G 2215/0125; G03B 27/72; B41J 2/385
USPC ..... 347/243, 256–261
See application file for complete search history.

(56) References Cited

U.S. PATENT DOCUMENTS 6,829,414 B2 * 12/2004 Suda ..... 385/35
7,209,273 B2 4/2007 Sobue
2004/0037584 A1 * 2/2004 Takahashi et al. ..... 399/100

FOREIGN PATENT DOCUMENTS

JP 2006-297755 A 11/2006

* cited by examiner

*Primary Examiner* — Sarah Al Hashimi
(74) *Attorney, Agent, or Firm* — Rossi, Kimms & McDowell LLP

(57) ABSTRACT

An image forming apparatus that is capable of simplifying controls for light sources. A polygon mirror with four reflective surfaces deflects light beams emitted from first and second light sources. A housing in which the light sources and the polygon mirror are arranged is configured so that optical paths of the light beams toward the polygon mirror are parallel to a virtual plane containing a rotating axis of the polygon mirror, and so that the light beams are incident on adjoining reflective surfaces of the polygon mirror. First and second driver ICs drive the first and second light sources in one of operation modes. A control unit outputs the same operation mode signal to the first and second driver ICs at the same timing so that the first and second light sources operate in the same operation mode.

21 Claims, 15 Drawing Sheets

*FIG. 6*

| TIME (μs) | 0 | 10 | 20 | 40 | 80 | 280 | 350 |
|---|---|---|---|---|---|---|---|
| CTL2 | 0 | 0 | 0 | 0 | 1 | 0 | 0 |
| CTL1 | 1 | 1 | 0 | 1 | 1 | 1 | 1 |
| CTL0 | 0 | 1 | 1 | 1 | 1 | 1 | 0 |

IMAGE FORMING APPARATUS WITH ELECTROPHOTOGRAPHIC SYSTEM

BACKGROUND OF THE INVENTION

1. Field of the Invention

The present invention relates to an image forming apparatus with an electrophotographic system that forms an image by developing an electrostatic latent image formed by scanning a plurality of photoconductors with a plurality of light beams.

2. Description of the Related Art

An image forming apparatus with an electrophotographic system forms an image by exposing a photoconductor with a laser beam (light beam) and by developing an electrostatic latent image formed on the photoconductor. The laser beam emitted from a light source (Laser Diode: LD) is deflected by a rotation polygon mirror so that the laser beam concerned scans the photoconductor. The laser beam deflected by the rotation polygon mirror is guided to the photoconductor through optical elements, such as lenses and mirrors. Japanese Laid-Open Patent Publication (Kokai) No. 2006-297755 (JP 2006-297755A) discloses a color image forming apparatus equipped with a photoconductor, an LD, and a rotation polygon mirror for each color. This publication discloses the image forming apparatus that corrects a deviation between toner images formed on the respective photoconductors by controlling rotation phases of the rotation polygon mirrors.

In an image forming apparatus with the electrophotographic system, a timing at which light quantity of a laser beam is controlled and an emission timing of a laser beam according to an image signal are controlled by a laser driver. The laser drivers are mounted on light sources of respective colors.

The technique of JP 2006-297755A controls the rotation phases so that a predetermined phase difference occurs among the rotation phases of the rotation polygon mirrors. Accordingly, such an image forming apparatus that is described in this publication controls laser drivers so that timings at which light quantity of laser beams are controlled and emission timings of the laser beams according to image signals differ for the respective LDs.

On the other hand, there is a known image forming apparatus that deflects laser beams emitted from light sources (LDs) corresponding to photoconductors with one rotation polygon mirror in order to miniaturize an optical system.

However, such an image forming apparatus cannot control the LDs easily when timings at which light quantity of laser beams are controlled and emission timings of the laser beams according to image signals differ for the respective LDs.

SUMMARY OF THE INVENTION

The present invention simplifies controls for light sources in an image forming apparatus that deflects the laser beams emitted from the light sources corresponding to photoconductors with one rotation polygon mirror.

Accordingly, a first aspect of the present invention provides an image forming apparatus comprising a first light source, a second light source, a rotation polygon mirror configured to have four reflective surfaces and to deflect a light beam emitted from the first light source and a light beam emitted from the second light source with the four reflective surfaces so that the light beam emitted from the first light source scans a first photoconductor and the light beam emitted from the second light source scans a second photoconductor, a housing in which the first light source, the second light source, and the rotation polygon mirror are arranged configured so that an optical path of the light beam emitted from the first light source toward the rotation polygon mirror and an optical path of the light beam emitted from the second light source toward the rotation polygon mirror are parallel to a virtual plane that is parallel to a rotating axis of the rotation polygon mirror and contains the rotating axis, and so that the light beam emitted from the second light source impinges on a reflective surface among the four reflective surfaces that adjoins to the reflective surface on which the light beam emitted from the first light source impinge at an upstream side in a rotating direction of the rotation polygon mirror, a first driver IC configured to drive the first light source in one operation mode among a plurality of operation modes, a second driver IC configured to drive the second light source in one operation mode among the plurality of operation modes, and a control unit configured to output the same operation mode signal to both the first driver IC and the second driver IC at the same timing so that the operation mode of the first light source is identical to the operation mode of the second light source.

Accordingly, a second aspect of the present invention provides an image forming apparatus comprising a first light source, a second light source, a third light source, a fourth light source, a rotation polygon mirror configured to have four reflective surfaces and to deflect light beams emitted from the first, second, third, and fourth light sources with the four reflective surfaces so that the light beams emitted from the first, second, third, and fourth light sources scan first, second, third, and fourth photoconductors, respectively, a housing in which the first light source, the second light source, the third light source, the fourth light source, and the rotation polygon mirror are arranged configured so that an optical path of the light beam emitted from the first light source toward the rotation polygon mirror and an optical path of the light beam emitted from the second light source toward the rotation polygon mirror are parallel to a virtual plane that is parallel to a rotating axis of the rotation polygon mirror and contains the rotating axis, so that the light beam emitted from the second light source impinges on a reflective surface among the four reflective surfaces that adjoins to the reflective surface on which the light beam emitted from the first light source impinge at an upstream side in a rotating direction of the rotation polygon mirror, so that the light beam emitted from the third light source impinges on the same reflective surface on which the laser beam emitted from the first light source impinges, and so that the laser beam emitted from the fourth light source impinges on the same reflective surface on which the laser beam emitted from the second light source impinges, a first driver IC configured to drive the first light source in one operation mode among a plurality of operation modes, a second driver IC configured to drive the second light source in one operation mode among the plurality of operation modes, a third driver IC configured to drive the third light source one operation mode among the plurality of operation modes, a fourth driver IC configured to drive the fourth light source in one operation mode among the plurality of operation modes, and a control unit configured to output the same operation mode signal to all the first driver IC, the second driver IC, the third driver IC, and the fourth driver IC at the same timing so that the operation mode of the first light source, the operation mode of the second light source, the operation mode of the third light source, and the operation mode of the fourth light source are identical.

According to the present invention, the first light source and the second light source are simply controllable.

Further features of the present invention will become apparent from the following description of exemplary embodiments with reference to the attached drawings.

BRIEF DESCRIPTION OF THE DRAWINGS

FIG. 6 is a view showing a control table showing signal patterns and switching timings of a control signal (3 bits) in the comparative example shown in FIG. 4.

DESCRIPTION OF THE EMBODIMENTS

Hereafter, embodiments according to the present invention will be described in detail with reference to the drawings.

Figure 1:
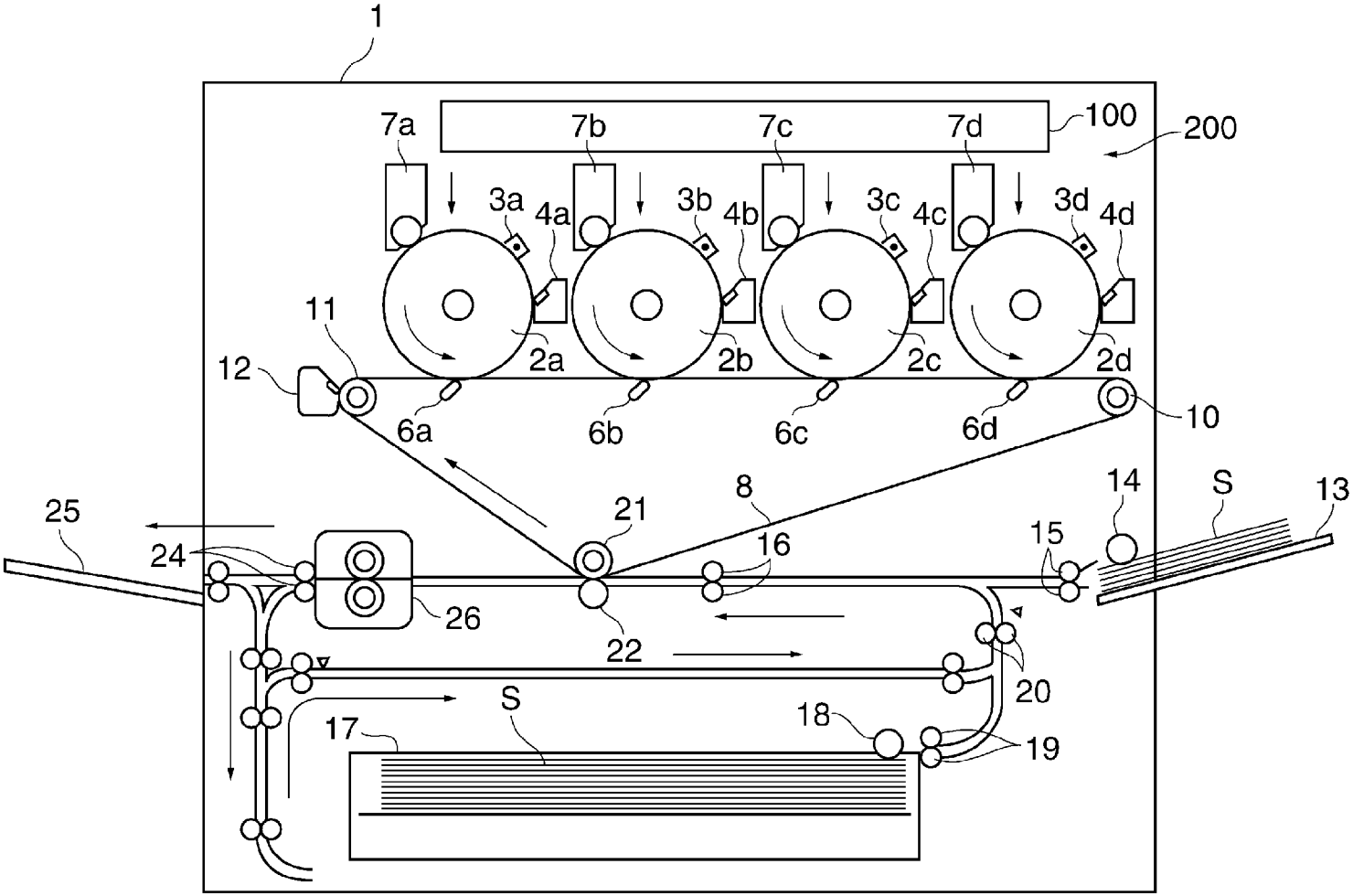
FIG. 1 is a sectional view schematically showing a configuration of an image forming apparatus according to a first embodiment.

FIG. 1 is a sectional view schematically showing a configuration of an image forming apparatus according to a first embodiment.

The image forming apparatus shown in FIG. 1 is a full color printer with an electrophotographic system (it is referred to as a "color printer", hereafter). The color printer 1 has an image forming unit 200 that forms an image of four colors including yellow (Y), magenta (M), cyan (C), and black (K). The image forming unit 200 has photosensitive drums 2*a* through 2*d* that function as photoconductors, electrostatic chargers 3*a* through 3*d*, cleaners 4*a* through 4*d*, development units 7*a* through 7*d*, and transfer blades 6*a* through 6*d*, for the respective colors.

The color printer 1 has a laser scan unit 100, an intermediate transfer belt 8, rollers 10, 11, and 21 that support the intermediate transfer belt 8, and a cleaner 12.

The color printer 1 has a manual feed tray 13 on which sheets S are stacked. The sheets S on the manual feed tray 13 are supplied into the apparatus by pickup rollers 14 and 15, and a registration gap in a sheet conveyance direction (a gap between a sheet and an image on the intermediate transfer belt 8 in the sheet conveyance direction) is corrected by a registration roller 16 during conveyance of the sheet S. The color printer 1 further contains a sheet cassette 17 that stores the sheets S. The sheets S in the sheet cassette 17 are supplied into a conveyance path by pickup rollers 18 and 19, and are conveyed by a longitudinal pass roller 20. A registration gap in the conveyance direction is corrected by the above-mentioned registration roller 16 during conveyance of the sheets S.

The color printer 1 has a secondary transfer roller 22, a fixing unit 26, an ejecting roller 24, and a sheet ejection tray 25.

Next, an image forming operation that the color printer 1 of such a configuration executes will be described.

When the color printer 1 forms an image, the surfaces of the photosensitive drums 2*a* through 2*d* corresponding to the respective colors are first charged uniformly at specified potential by the electrostatic chargers 3*a* through 3*d*, respectively. The laser scan unit 100 emits laser beams (light beams) from LDs corresponding to the respective colors according to image signals that are generated by decomposing image data inputted from the outside for the respective colors (Y, M, C, and K). A laser beam corresponding to each color is deflected by a polygon mirror, and is converted into a scanning beam. The laser beam deflected by the polygon mirror is guided to each of the photosensitive drums 2*a* through 2*d* through a lens, a reflective mirror, etc., and exposes a surface of each of the photosensitive drums 2*a* through 2*d*. As a result, an electrostatic latent image corresponding to the image signal of each color is formed on each of the photosensitive drums 2*a* through 2*d*.

The electrostatic latent images formed on the photosensitive drums 2*a* through 2*d* are developed by the corresponding development devices 7*a* through 7*d*, respectively. Specifically, the development devices 7*a* through 7*d* form toner images of the respective colors by making toners of the respective colors adhere to the electrostatic latent images on the corresponding photosensitive drums 2*a* through 2*d*. Then, a color image (toner image) is formed on the intermediate transfer belt 8 by transferring the toner images of the respective colors on the photosensitive drums 2*a* through 2*d* to the intermediate transfer belt 8. It should be noted that the cleaners 4*a* through 4*d* collect and remove the residual toners on the photosensitive drums 2*a* through 2*d*, respectively.

Next, a sheet S is conveyed to a secondary transfer position at the timing that the front end of the toner image on the intermediate transfer belt 8 enters into the secondary transfer position between a rotary roller 21 and a secondary transfer roller 22. The toner image on the intermediate transfer belt 8 is transferred onto the sheet S, which is conveyed to the secondary transfer position, by the secondary transfer roller 22.

The sheet S onto which the toner image was transferred is conveyed to the fixing unit 26. The fixing unit 26 heats and fixes the toner image to the surface of the sheet S by heating and pressing the toner image. An ejecting roller 24 ejects the sheet S on which the toner image was fixed with heating to the sheet ejection tray 25, which finishes the series of image forming operations. The cleaner 12 collects and remove residual toner on the intermediate transfer belt 8.

When images are formed on both sides of the sheet S, the sheet S ejected from the fixing unit 26 is once conveyed to a turning conveyance path, and is turned upside down. Then, the sheet S is again conveyed to the secondary transfer position through the longitudinal pass roller 20, and an image is formed on the other side in the same manner as mentioned above.

Figure 2A:
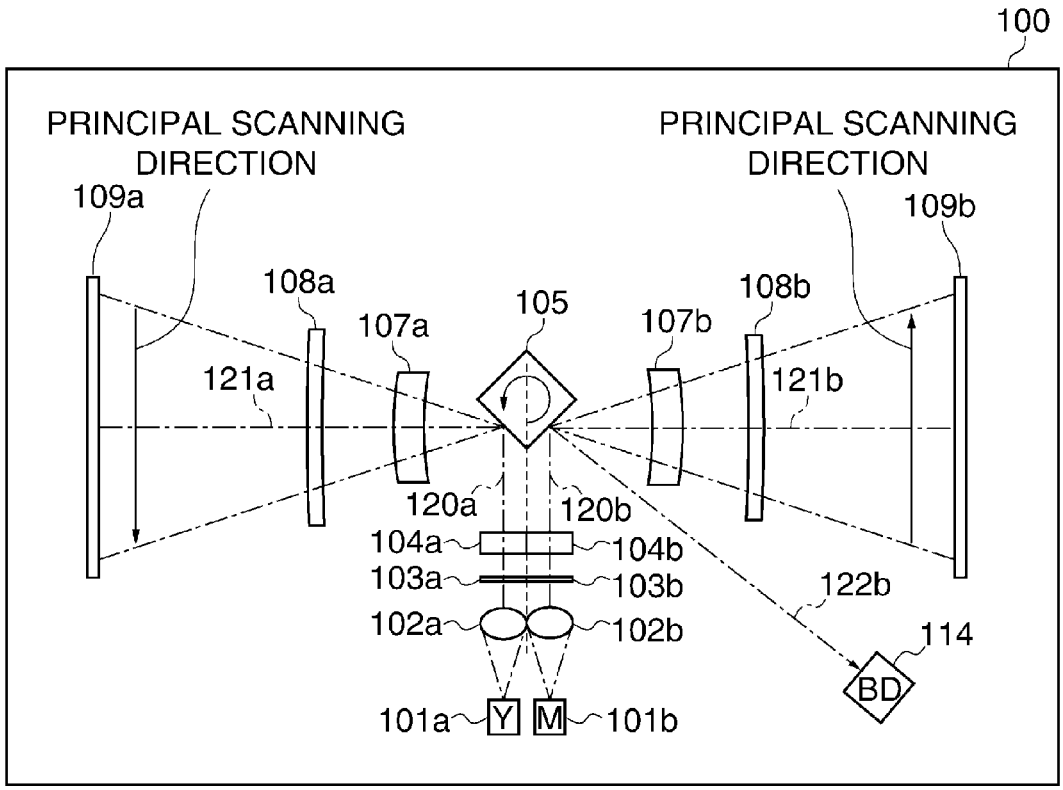
FIG. 2A is a plan view schematically showing a configuration for a Y-image and an M-image of a laser scan unit with which the image forming apparatus shown in FIG. 1 is provided.
Figure 2B:
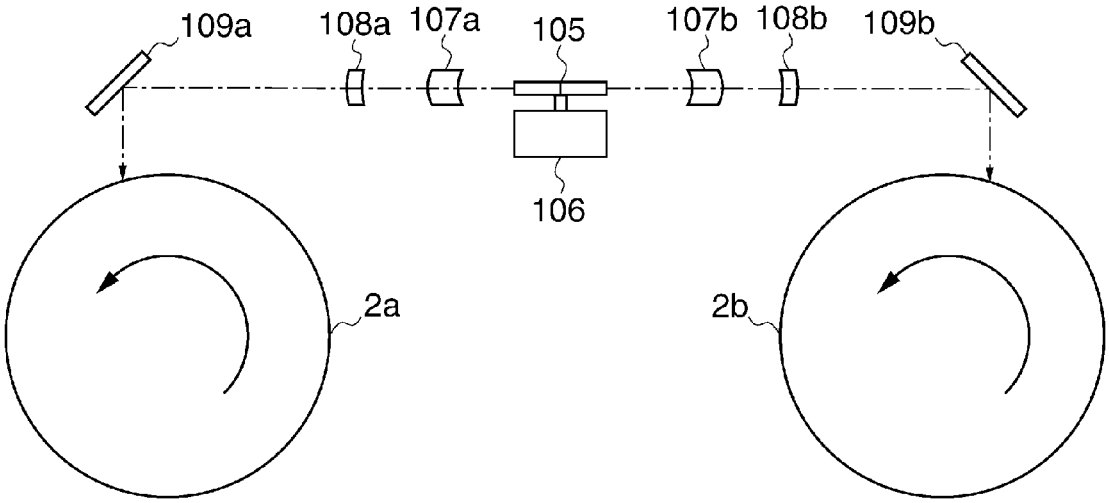
FIG. 2B is a front view schematically showing the configuration of the laser scan unit shown in FIG. 2A.

FIG. 2A is a plan view schematically showing a configuration for a Y-image and an M-image of the laser scan unit 100. FIG. 2B is a front view schematically showing the configuration of the laser scan unit 100. Since the laser scan unit 100 is provided with the same configuration for a C-image and a K-image, it is provided with two sets of the configurations shown in FIG. 2A and FIG. 2B.

The laser scan unit 100 is provided with a housing in which constructional elements are arranged, and has two light sources 101*a* and 101*b*. The light source 101*b* functions as a first light source in the embodiment, and the light source 101*a* functions as a second light source in the embodiment. The light source 101*a* and the light source 101*b* are arranged in the laser scan unit 100 so that an optical path of a laser beam that is emitted from the light source 101*a* and goes to the polygon mirror 105 becomes parallel to an optical path of a laser beam that is emitted from the light source 101*b* and goes to the polygon mirror 105. Namely, the laser scan unit of the embodiment is configured so that the optical path of the laser beam 120*a* that is emitted from the first light source 101*a* towards the polygon mirror 105 and the optical path of the laser beam 120*b* that is emitted from the second light source 101*b* towards the polygon mirror 105 become parallel to a virtual plane (a dotted line shown in FIG. 2A) that is parallel to the rotating axis of the polygon mirror 105 and contains the rotating axis. The word "parallel" here does not define mathematical strict meaning, but it defines approximate meaning including a condition that can be deemed parallel practically. The polygon mirror that functions as a rotation polygon mirror will be later described in detail.

The light source 101*a* is used for a Y-image, and the light source 101*b* is used for an M-image. Then, another laser scan unit having the same configuration as the laser scan unit 100 is mounted for printing a C-image and a K-image. As a result of this, all of Y-, M-, C-, and K-images can be printed.

The laser scan unit 100 has the light sources 101*a* and 101*b*, collimating lenses 102*a* and 102*b*, aperture diaphragms 103*a* and 103*b*, and cylindrical lenses 104*a* and 104*b*, for a Y-image and an M-image. Moreover, the laser scan unit 100 has toric lenses 107*a* and 107*b*, diffraction optical elements 108*a* and 108*b*, and folding mirrors 109*a* and 109*b*, for a Y-image and an M-image. Furthermore, the laser scan unit 100 has the polygon mirror 105 that is driven to rotate and a scanner motor 106 that drives the polygon mirror 105.

The collimating lenses 102*a* and 102*b* convert the laser beams 120*a* and 120*b* emitted from the light sources 101*a* and 101*b*, respectively, into parallel beams. The aperture diaphragms 103*a* and 103*b* specify the beam diameters of the passing laser beams 120*a* and 120*b*. The cylindrical lenses 104*a* and 104*b* have specified refractive power only in an auxiliary scanning direction (a direction corresponding to the rotation direction of the photosensitive drum), and refract the laser beams 120*a* and 120*b* to form elliptical images that are long in a principal scanning direction on the reflective surfaces of the polygon mirror 105.

The polygon mirror 105 is rotated by the scanner motor 106 at a constant speed in the counterclockwise direction shown by an arrow in FIG. 2A, and deflects incident laser beams on the reflective surfaces.

The polygon mirror 105 is a square in the plan view as shown in FIG. 2A, and has four reflective surfaces. The length of the diagonal line of the polygon mirror 105 is longer than the distance between the optical path of the laser beam 120*a* emitted from the light source 101*a* and the optical path of the laser beam 120*b* emitted from the light source 101*b*. Accordingly, the laser beam 102*a* emitted from the light source 101*a* and the laser beam 120*b* emitted from the light source 101*b* impinge on the adjoining reflective surfaces. Since the polygon mirror 105 rotates in the counterclockwise direction as shown in FIG. 2A, the reflective surface on which the laser beam 120*a* emitted from the light source 101*a* impinges is located at the upstream side in the rotation direction than the reflective surface on which the laser beam 120*b* emitted from the light source 101*b* impinges.

The four reflective surfaces deflect the laser beam 120*a* emitted from the light source 101*a* so that the laser beam 120*a* scans the first photosensitive drum 2*a*, and deflect the laser beam 120*b* emitted from the light source 101*b* so that the laser beam 120*b* scans the second photosensitive drum 2*b*.

In FIG. 2A, the laser beam 120*a* for a Y-image is deflected to the left side by the polygon mirror 105, and the laser beam 120*b* for an M-image is deflected to the right side by the polygon mirror 105. The laser beam 121*a* deflected by the polygon mirror 105 is guided to the photosensitive drum 2*a* through the toric lens 107*a*, the diffraction optical element 108*a*, and the folding mirror 109*a*. The laser beam 121*b* deflected by the polygon mirror is guided to the photosensitive drum 2*b* through the toric lens 107*b*, the diffraction optical element 108*b*, and the folding mirror 109*b*.

The refractive power of the toric lenses 107*a* and 107*b* in the principal scanning direction is different from that in the auxiliary scanning direction. Both the front and rear lens surfaces of the toric lenses 107*a* and 107*b* are aspheric surfaces. Magnification of the diffraction optical elements 108*a* and 108*b* in the principal scanning direction differs from that in the auxiliary scanning direction. A combination of the toric lens 107*a* and the diffraction optical element 108 achieves fθ characteristics so that the laser beam deflected by the polygon mirror 105 scans the photosensitive drum 2*a* at a uniform velocity. Similarly, a combination of the toric lens 107*b* and the diffraction optical element 108*b* achieves the fθ characteristics.

The laser beam 120*a* moves (scans) downward in FIG. 2A because it is deflected by the polygon mirror 105. On the other hand, the laser beam 120*b* moves (scans) upward in FIG. 2A because it is deflected by the polygon mirror 105.

Since the laser scan unit 100 of the first embodiment is provided with the polygon mirror 105 having four reflective surfaces, and the laser beams 120*a* and 120*b* impinge on the adjoining reflective surfaces through the parallel optical paths, the scanning position of the laser beam 102*a* and the scanning position of the laser beam 102*b* become point symmetry with respect to a specified point included in the virtual plane.

The laser beam for an M-image deflected by the polygon mirror 105 enters a beam detection unit (Beam Detector: BD) 114 arranged on the scanning path of the laser beam concerned. The BD 114, which is a signal generating unit, outputs a signal (referred to as a "BD signal", hereafter) that shows a scanning timing (a reference timing) based on the incident laser beam 122*b*. Namely, the BD 114 receives the laser beam that is emitted from the light source 101*b* and is deflected by the polygon mirror 105, and outputs a synchronizing signal in response to the reception of the laser beam concerned. A laser control unit mentioned later changes an operation mode signal that is transmitted to below-mentioned laser drivers 304*a* and 304*b* based on a generating timing of the synchronizing signal generated by the BD 114. Accordingly, in one scanning period of the laser beam, an emission of the laser beam from the light source 101*b* according to image data starts after elapsing predetermined time from the timing at which the BD 114 outputs the BD signal. It should be noted that an emission timing of the laser beam from the light source 101*a* and a control of an operation mode are also controlled based on the BD signal outputted from the BD 114.

Hereinafter, a control system of the image forming apparatus according to the embodiment will be described in detail as compared with a control system of a comparative example.

Figure 3A:
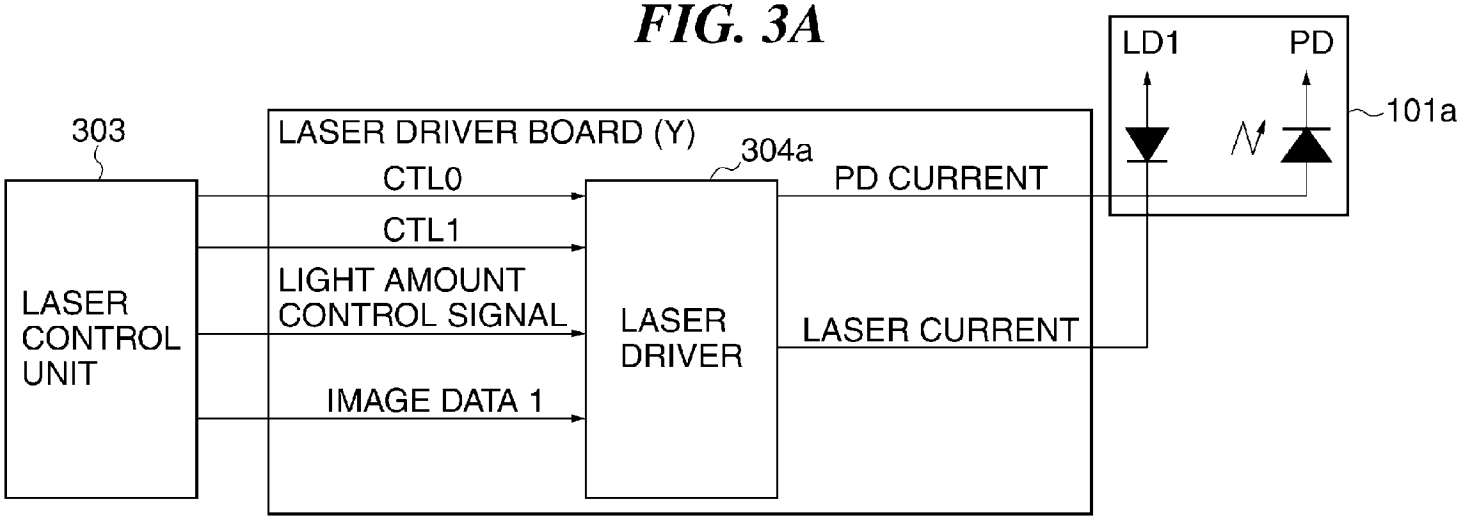
FIG. 3A is a block diagram schematically showing a configuration in a case of emitting a single laser beam among control systems that control LDs included in the laser scan unit shown in FIG. 1.
Figure 3B:
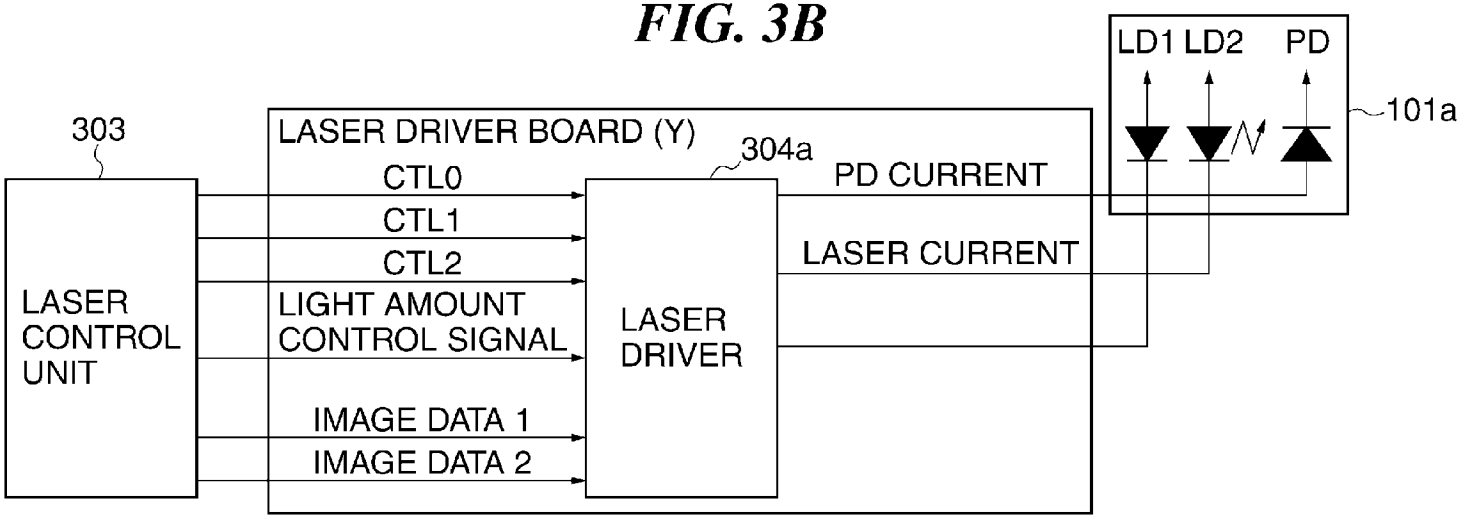
FIG. 3B is a block diagram schematically showing a configuration in a case of emitting a plurality of laser beams among control systems that control LDs included in the laser scan unit shown in FIG. 1.

FIG. 3A and FIG. 3B are block diagrams schematically showing configurations of control systems that control LDs included in the laser scan unit shown in FIG. 1. FIG. 3A shows a configuration that emits a single laser beam using one LD for each color, and FIG. 3B shows a configuration that emits a plurality of laser beams (two beams) using a plurality of LDs (two LDs) for each color. It should be noted that FIG. 3A and FIG. 3B are the block diagrams showing the outline configurations for forming an image of one color among Y, M, C, and K. Accordingly, an apparatus that forms a color image like the color printer 1 according to the embodiment is provided with four sets of the configurations shown in FIG. 3A or FIG. 3B. Moreover, the configurations of the control systems shown in FIG. 3A and FIG. 3B are common also in the below-mentioned comparative example.

In the control system that uses one LD for each color shown in FIG. 3A, a laser control unit 303 transmits control signals (operation mode signals) for changing an operation mode to a laser driver 304*a* (a laser driver IC: Laser Driver Integral Circuit). The number of the control signals is determined by the number of operation modes of the laser driver 304*a*. The operation modes include an Auto Power Control (APC) mode for an LD1, an OFF mode, an image mode, etc. Since the laser driver 304*a* in FIG. 3A drives the light source 101*a* that merely includes the LD1, the control signals consist of two bits of CTL0 and CTL1.

In the control system that uses two LDs for each color shown in FIG. 3B, a laser control unit 303 transmits control signals (operation mode signals) for changing an operation mode to a laser driver 304*a*. When the number of laser beams increases corresponding to the number of LDs, the number of the APC modes also increases, which increases the number of control signals. Since the laser driver 304*a* in FIG. 3B drives the light source 101*a* that includes LD1 and LD2, the control signals consist of three bits of CTL0, CTL1, and CTL2.

The above-mentioned operation modes will be described. When controlling a light amount of a laser beam to be a specified value, a laser driver adjusts an electric current supplied to a controlled LD so that a photo detector (Photodiode: PD) attached to the LD concerned outputs a specified value. This is called an APC, and an operation mode for performing this APC operation is called an "APC mode". Since the APC cannot be performed in the period when a laser beam scans an electrostatic latent image formation area on a photoconductor, it is performed at a timing other than the period when scanning the electrostatic latent image formation area.

Moreover, the laser driver supplies a driving current to the LD according to image data transmitted from the laser control unit during an image formation. The operation mode of the laser driver at this time shall be an "image mode". On the other hand, the laser driver does not supply a driving current to the LD in the period when the laser beam is not irradiated. The operation mode of the laser driver at this time shall be an "OFF mode". The laser driver is set to the OFF mode when a laser beam emitted from the LD may form a ghost image, etc. In the OFF mode, the LD is not emitted while storing the light amount value in the APC mode. On the other hand, the state where the light amount value in the APC mode is reset to "0" is called a "discharge mode". In this mode, the LD does not emit light. It should be noted that the "APC mode" and the "image mode" in which the LD can emit light are collectively defined as an "enable mode". Moreover, the "OFF mode" and the "discharge mode" in which the LD cannot emit light are collectively defined as a "disable mode".

The laser control unit 303 in FIG. 3A transmits a light amount control signal for setting up the light amount of the laser beam, and image data 1 for drawing an image to the laser driver 304*a*. The laser control unit 303 in FIG. 3B transmits a light amount control signal for setting up the light amount of the laser beam, and image data 1 and image data 2 for drawing an image to the laser driver 304*a*.

Figure 4:
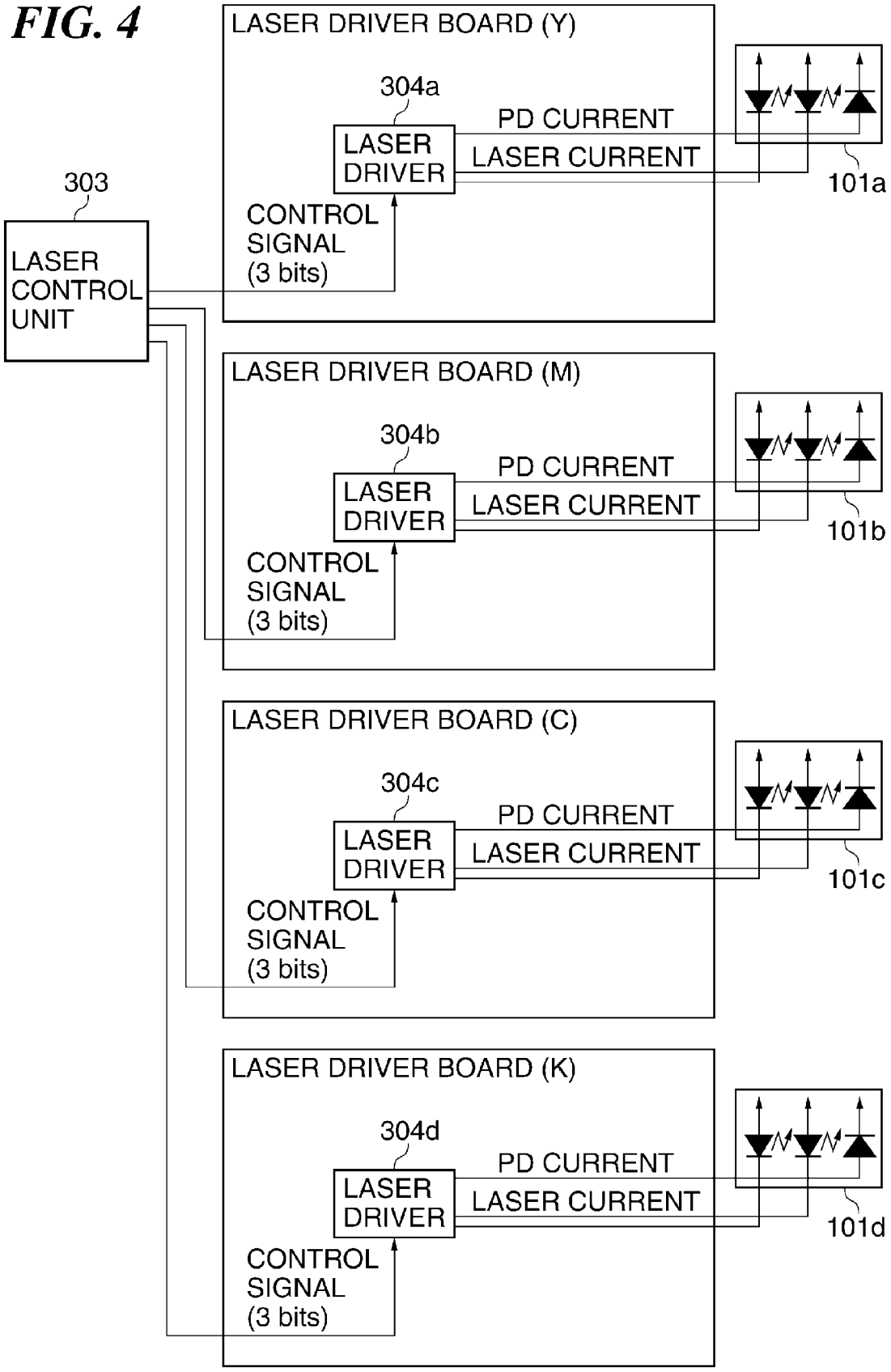
FIG. 4 is a block diagram schematically showing a connecting configuration between a laser control unit and laser drivers of Y-, M-, C-, and K-stations according to a comparative example.

FIG. 4 is a block diagram schematically showing a connecting configuration between a laser control unit 303 and laser drivers 304*a* through 304*d* of Y-, M-, C-, and K-stations according to a comparative example. The comparative example assumes that each of the Y-, M-, C-, and K-stations is provided with a polygon mirror and a BD like the apparatus disclosed in JP 2006-297755A mentioned above. In FIG. 4, only wirings that transmit the laser control signals are illustrated and wirings that transmit the light amount control signals, the image data 1, and the image data 2, which certainly needs to be transmitted independently for each station, are not illustrated.

As shown in FIG. 4, the laser driver 304*a* and the laser control unit 303 are connected through a first wiring, and the laser control unit 303 transmits an operation mode signal to the laser driver 304*a* through the first wiring. Moreover, the laser driver 304*b* and the laser control unit 303 are connected through a second wiring, and the laser control unit 303 transmits an operation mode signal to the laser driver 304*b* through the second wiring. Moreover, the laser driver 304*c* and the laser control unit 303 are connected through a third wiring, and the laser control unit 303 transmits an operation mode signal to the laser driver 304*c* through the third wiring. Moreover, the laser driver 304*d* and the laser control unit 303 are connected through a fourth wiring, and the laser control unit 303 transmits an operation mode signal to the laser driver 304*d* through the fourth wiring. Since the control signal is transmitted through three signal lines in parallel for each color, each of the control signals is written as the control signal (3 bits). That is, the comparative example shown in FIG. 4 needs the twelve signal lines in total.

The laser drivers 304*a*, 304*b*, 304*c*, and 304*d* drive the light sources 101*a*, 101*b*, 101*c*, and 101*d*, respectively, in one of the above-mentioned operation modes. Since the laser scan unit of the comparative example is provided with the four polygon mirrors, the laser control unit 303 needs to change the operation modes of the laser drivers 304*a*, 304*b*, 304*c*, and 304*d* at respectively inherent timings. Accordingly, the twelve signal lines are needed in total as mentioned above.

Figure 5:
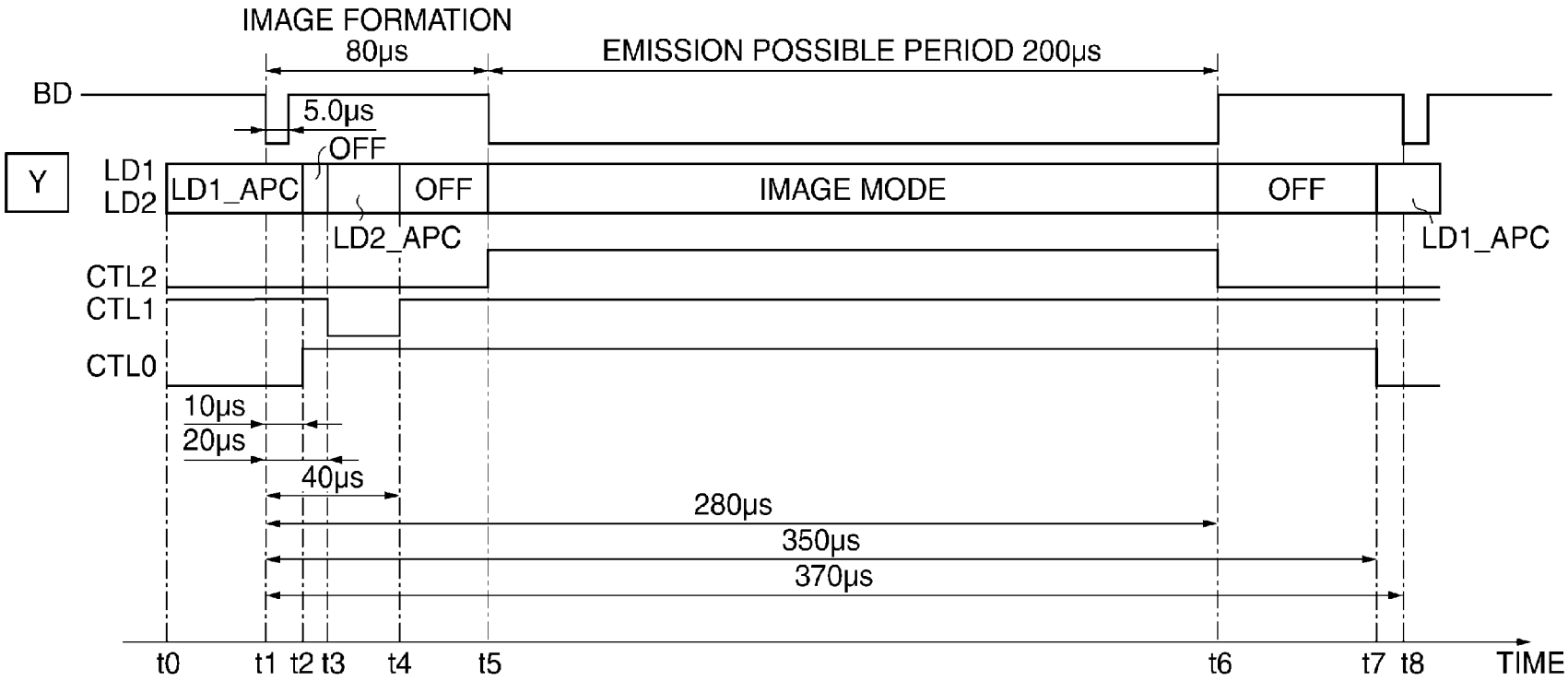
FIG. 5 is a timing chart showing timings at which the laser driver of the Y-station in the comparative example in FIG. 4 changes an operation mode.

FIG. 5 is a timing chart showing timings at which the laser driver 304*a* of the Y-station in the comparative example in FIG. 4 changes the operation mode.

As shown in FIG. 5, the laser driver 304*a* in FIG. 4 changes the operation mode to the APC mode of the LD1 just before the laser beam enters the BD of the Y-station because the laser driver 304*a* drives the light source 101*a* (at a timing t0). Then, the laser driver 304*a* adjusts the light amount of the LD1 at a timing when the BD detects the laser beam (at a timing t1). At this time, the light amount of the LD1 is adjusted based on the output of the PD (photo detector) attached to the LD1 (the built-in PD).

Next, the laser driver 304*a* changes the operation mode to the OFF mode of the LD1 and the LD2 (at a timing t2), and then, changes the operation mode to the APC mode of the LD2 (at a timing t3) to adjust the light amount of the LD2. The light amount of the LD2 is adjusted like the light amount of the LD1. At the subsequent timing t4, the laser driver 304*a* changes the operation mode to the OFF mode of the LD1 and the LD2, and keeps the mode until an image formation timing t5.

Then, the laser driver 304*a* changes the operation mode to the image mode of the LD1 and the LD2 at the image formation timing t5, receives the image data 1 and the image data 2 from the laser control unit 303, and switches the LD1 and the LD2 according to the image data 1 and the image data 2, respectively.

The operation mode is changed as follows based on the control signal (CTL0, CTL1, and CTL2) from the laser control unit 303.

APC mode of LD1: CTL0="0", CTL1="1", CTL2="0"
OFF mode: CTL0="1", CTL1="1", CTL2="0"
APC mode of LD2: CTL0="1", CTL1="0", CTL2="0"
Image mode: CTL0="1", CTL1="1", CTL2="1"
Discharge mode: CTL0="0", CTL1="0", CTL2="0"

Here, CTL0, CTL1, and CTL2 show first, second, and third bits of the control signal (3 bits), the value of "0" represents "low level", and "1" represents "high level". Moreover, the operation mode is changed at a timing after elapsing predetermined time from the timing (t1) at which the BD 114 detects the laser beam.

FIG. 6 is a view showing a control table showing signal patterns and switching timings of the control signal (3 bits) in the case shown in FIG. 4. This control table is determined in advance, and is stored in a nonvolatile memory (not shown) that is built in the laser control unit 303, for example.

As shown in FIG. 6, the operation mode is changed from the APC mode of the LD1 ("010") to the OFF mode ("011") at the timing t2 in 10 microseconds after the timing t1 in FIG. 5 at which the BD 114 detects the laser beam. Then, the operation mode is changed to the APC mode of the LD2 ("001") in 20 microseconds (at the timing t3), and is changed to the OFF mode ("011") in 40 microseconds after the laser beam detection timing t1. Then, the operation mode is changed to the image mode ("111") in 80 microseconds (at the timing t5), and is changed to the OFF mode ("011") in 280 microseconds (at the timing t6). Furthermore, the operation mode is changed to the APC mode of the LD1 ("010") in 350 microseconds (at the timing t7) after the laser beam detection timing t1. Since not only the Y-station but also the LD1 of the M-station emits a laser beam in the APC mode of the LD1, the BD 114 detects the laser beam that forms the next line.

The laser control unit 303 of the comparative example shown in FIG. 4 is provided with the four control tables shown in FIG. 6 for the Y-, M-, C-, and K-stations, respectively.

Figure 7:
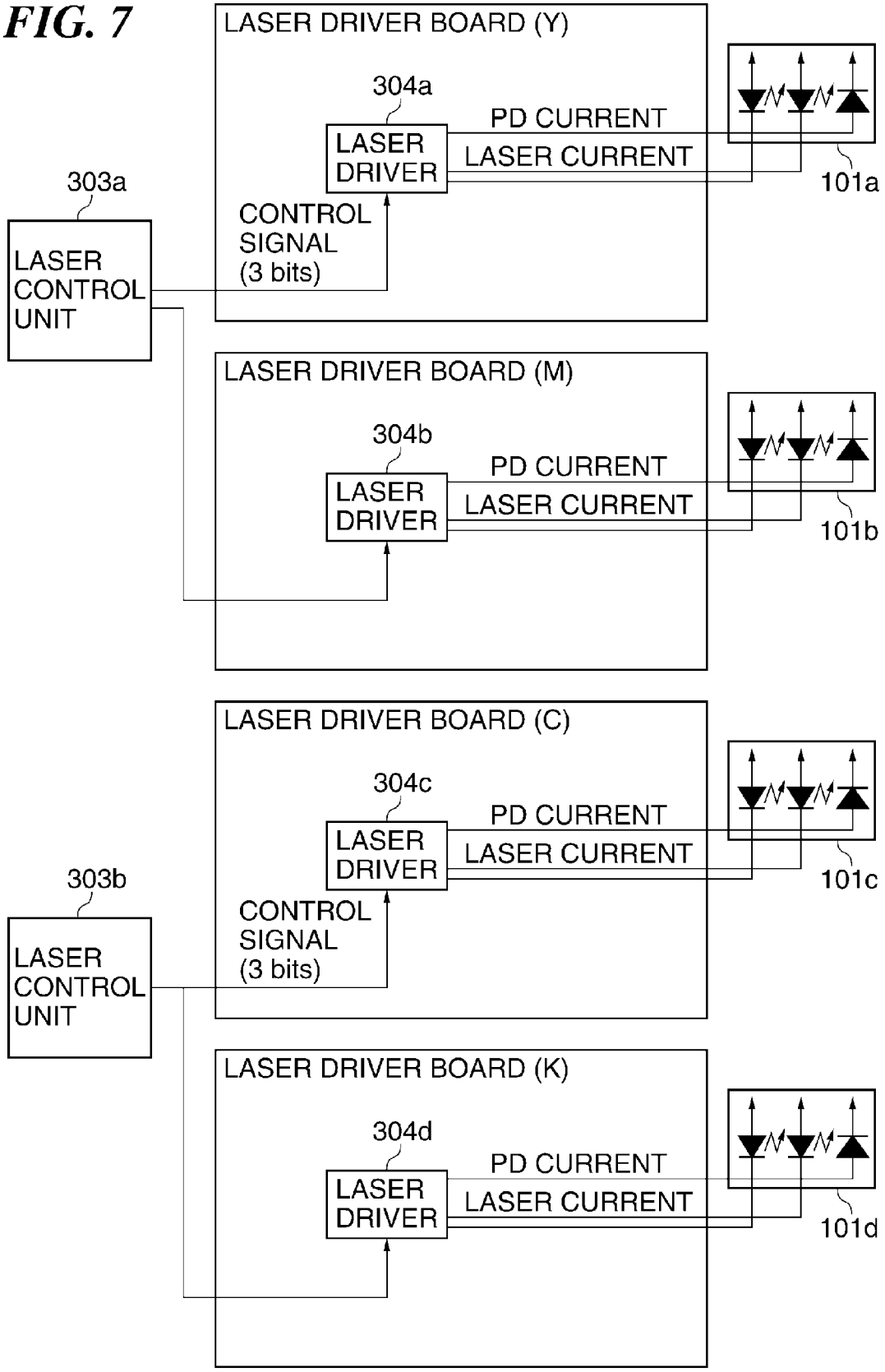
FIG. 7 is a block diagram schematically showing a connection configuration between a laser control unit and laser drivers of Y-, M-, C-, and K-stations according to the first embodiment.

The description about the comparative example is finished, and the description about the first embodiment continues hereafter. FIG. 7 is a block diagram schematically showing a connection configuration between a laser control unit and laser drivers of Y-, M-, C-, and K-stations according to the first embodiment. As shown in FIG. 7, a laser control unit 303*a* and a laser driver 304*a* are connected through a first wiring for transferring an operation mode signal, and a second wiring that is branched from the first wiring on the way is similarly connected to a laser driver 304*b* as a wiring for transferring an operation mode signal. The laser driver 304*a* functions as the first driver IC in the embodiment, and the laser driver 304*b* functions as the second driver IC in the embodiment. Moreover, a laser control unit 303*b* and a laser driver 304*c* are connected through a third wiring for transferring an operation mode signal, and a fourth wiring that is branched from the third wiring on the way is similarly connected to a laser driver 304*d* as a wiring for transferring an operation mode signal.

The optical system of the laser scan unit 100 of the first embodiment is configured to be divided into two groups of left side and right side as shown in FIG. 2. Moreover, the scanning position of the laser beam 102*a* and the scanning position of the laser beam 102*b* become point symmetry with respect to a specified point included in the virtual plane as mentioned above. Accordingly, the period during which the laser beam 102*a* scans the corresponding photosensitive drum coincides approximately with the period during which the laser beam 102*b* scans the corresponding photosensitive drum. This configuration allows the laser drivers 304*a* and 304*b* for a Y-image and an M-image to be controlled in common using the single control table in FIG. 6. Accordingly, the laser control unit 303*a* outputs the same operation mode signals to the laser drivers 304*a* and 304*b* at the same timings according to the BD signal so that the operation modes of the light sources 101*a* and 101*b* become identical.

Since the configuration in FIG. 2 is applied for forming a C-image and a K-image, too, the laser drivers 304*c* and 304*d* for a C-image and a K-image can be controlled in common using another control table. Accordingly, in the configuration in FIG. 7, the laser control unit 303*a* is provided with the control table corresponding to both the Y- and M-stations, and the laser control unit 303*b* is provided with the control table corresponding to both the C- and K-stations.

In the configuration of the comparative example shown in FIG. 4, the laser control unit 303 transmits the individual control signal (3 bits) to each of the laser drivers 304*a* through 304*d*. On the other hand, in the control system of the embodiment shown in FIG. 7, the common control signal (3 bits) is shared with both the Y-station and the M-station, and the C-station and the K-station share another common control signal similarly. As a result, the embodiment needs the six signal lines in total for the Y-, M-, C-, and K-stations. That is, the number of the signal lines can be reduced by half as compared with the comparative example that needs the twelve signal lines.

As mentioned above, since the embodiment employs the single control table for two optical systems of which switching timings are identical and controls two laser driver using the single control table, the number of signal lines for controlling the laser drivers can be reduced.

Figure 8:
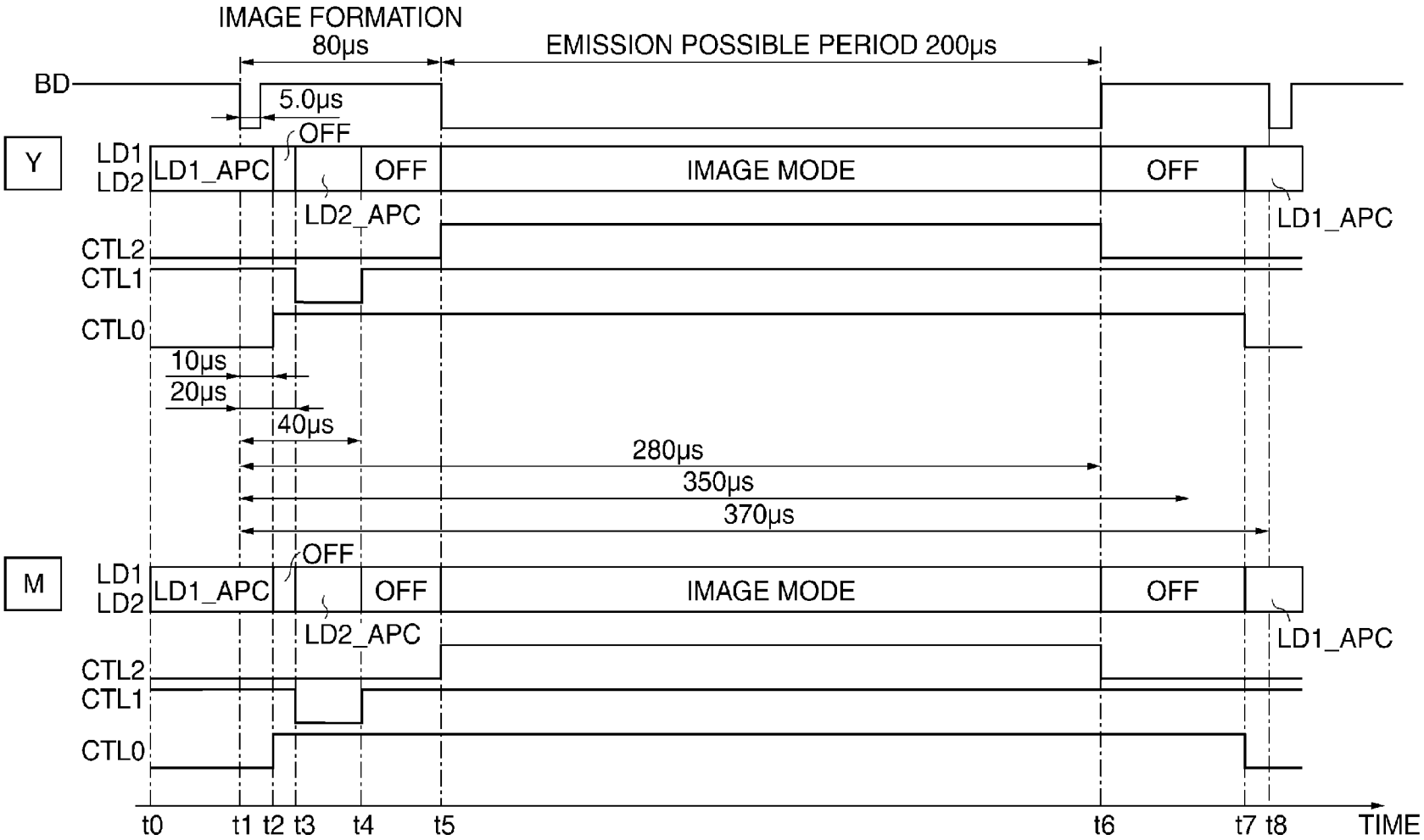
FIG. 8 is a timing chart showing timings at which the laser drivers of the Y-station and the M-station in FIG. 7 change operation modes.

FIG. 8 is a timing chart showing timings at which the laser drivers 304*a* and 304*b* of the Y-station and the M-station in FIG. 7 change the operation modes.

As shown in FIG. 8, each of the laser drivers 304*a* and 304*b* changes the operation mode to the APC mode of the LD1 just before the laser beam enters the BD 114 (at a timing t0). Then, the BD 114 detects the laser beam (at a timing t1), and each of the laser drivers 304*a* and 304*b* adjusts the light amount of the LD1. At this time, the light amount of the LD1 is adjusted based on the output of the PD (photo detector) attached to the LD1 (the built-in PD). That is, the PD receives the laser beam emitted from the LD1 as a light source, and each of the laser drivers 304*a* and 304*b* executes the light amount control (APC) that controls the light amount of the laser beam emitted from the LD1 based on the light receiving result of the PD.

Next, each of the laser drivers 304*a* and 304*b* changes the operation mode to the OFF mode of the LD1 and the LD2 (at a timing t2), and then, changes the operation mode to the APC mode of the LD2 (at a timing t3) to adjust the light amount of the LD2. The light amount of the LD2 is adjusted like the light amount of the LD1. At the subsequent timing t4, each of the laser drivers 304*a* and 304*b* changes the operation mode to the OFF mode of the LD1 and the LD2, and keeps the mode until an image formation timing t5. The laser control unit 303*a* transmits an enable signal that drives the LD1 and the LD2 in the enable mode, or a disable signal that drives the LD1 and the LD2 in the disable mode, as the operation mode signal to the laser drivers 304*a* and 304*b*.

Then, each of the laser drivers 304*a* and 304*b* changes the operation mode to the image mode of the LD1 and the LD2 at the image formation timing t5, receives the image data 1 and the image data 2 from the laser control unit 303*a*, and switches the LD1 and the LD2 according to the image data 1 and the image data 2, respectively. In the image mode, the laser beams emitted from the LD1 and the LD2 scan electrostatic latent image formation areas on the corresponding photoconductors, respectively. In the image mode, the laser control unit 303*a* outputs an enable signal to the laser drivers 304*a* and 304*b* at the timing based on a synchronizing signal in order to allow the respective LDs to emit laser beams.

Moreover, the laser control unit 303*a* outputs the enable signal to the laser drivers 304*a* and 304*b* at the timing based on the synchronizing signal also in a period other than the image mode period. As a result of this, the above-mentioned light amount control is executed during a period other than the image mode period. Moreover, the laser control unit 303*a* outputs a disable signal to the laser drivers 304*a* and 304*b* at the timing at which the light amount control finishes. Each of the LD1 and the LD2 has a plurality of light emission points of the same number. The laser control unit 303*a* outputs the enable signal at a plurality of times so that the light amount control is performed for each of the light emitting points in a period other than the image mode period, and then, outputs the disable signal after outputting the enable signal.

Moreover, the switching timings of CTL0 through CTL2 for the Y-station are identical to that for the M-station as shown in FIG. 8. This is because the laser driver 304*a* of the Y-station (see FIG. 7) can switch the operation mode at the timings at which the laser driver 304*b* of the M-station switches the operation mode based on the BD signal detected at the side of the M-station concerned. Strictly speaking, since the reflective surfaces of the polygon mirror 105 that reflect the laser beams of the Y-station and the M-station are different at the same time, manufacture errors of the reflective surfaces of the polygon mirror 105 cause difference between scanning speeds of the Y-station and the M-station. Accordingly, when the writing-start timing of the Y-station at the time of the image formation is determined based on the BD signal detected by the M-station, a position of a Y-image may deviate in the principal scanning direction, even if a position of an M-image is correct. For example, the Y-image deviates in one rotational period of the polygon mirror 105. However, deviation of some of the switching timing of each operation mode in the laser drivers 304*a* and 304*b* does not become a problem. The reason is that it is common to design so as to give some margin to the period during which each of the laser drivers 304*a* and 304*b* makes each of the light sources 101*a* and 101*b* perform the APC operation. Moreover, even if the switching timing to the mode in which image data is received (i.e., the image mode) has some errors, it does not become a problem because the image writing start timing is determined based on image data. Thus, when the deviation between the timings at which the laser driver 304*a* and 304*b* change the operation mode results from the manufacture error of the polygon mirror 105, the deviation in particular will not become a problem.

Next, a second embodiment of the present invention will be described. In a laser scan unit in the second embodiment, Y-, M-, C-, and K-stations share one polygon mirror. The other configurations in the second embodiment are similar to that of the color printer 1 in the first embodiment. Accordingly, the hardware of the color printer in the second embodiment is the same as the hardware of the color printer 1 in the first embodiment, and employs the hardware shown in FIG. 1 as is.

Hereinafter, the second embodiment will be described in detail while focusing on different points from the first embodiment.

Figure 9A:
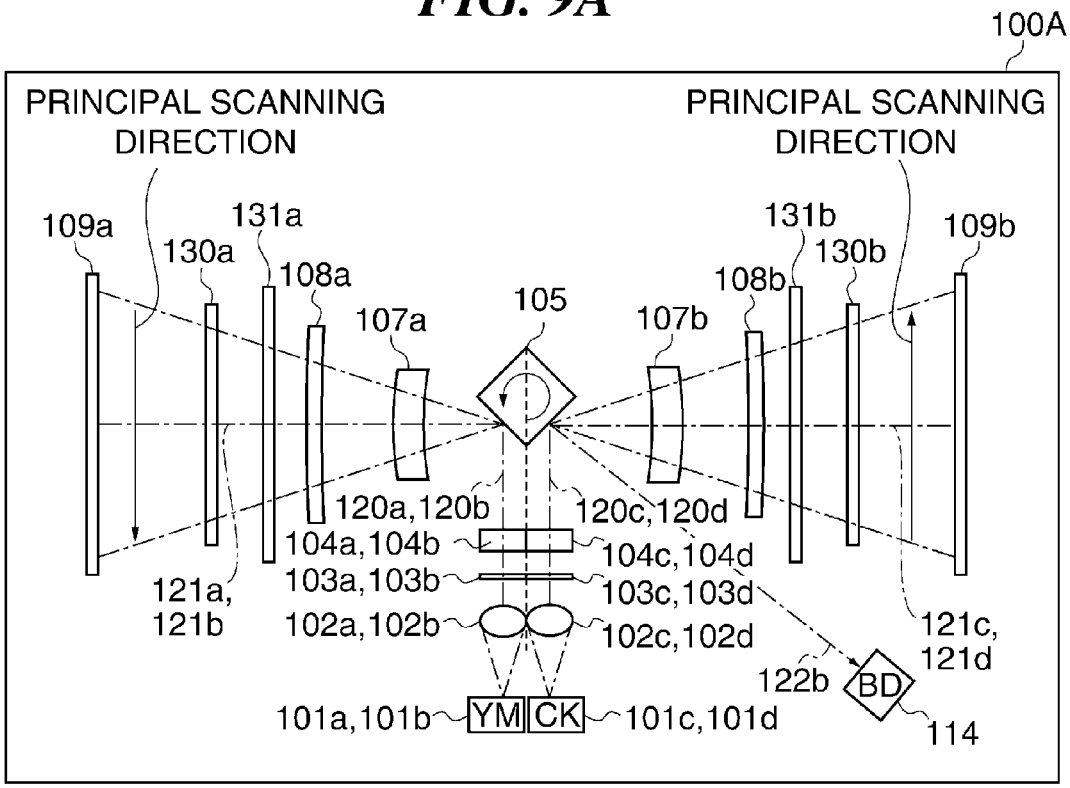
FIG. 9A is a plan view schematically showing a configuration of a laser scan unit with which the image forming apparatus according to a second embodiment is provided.
Figure 9B:
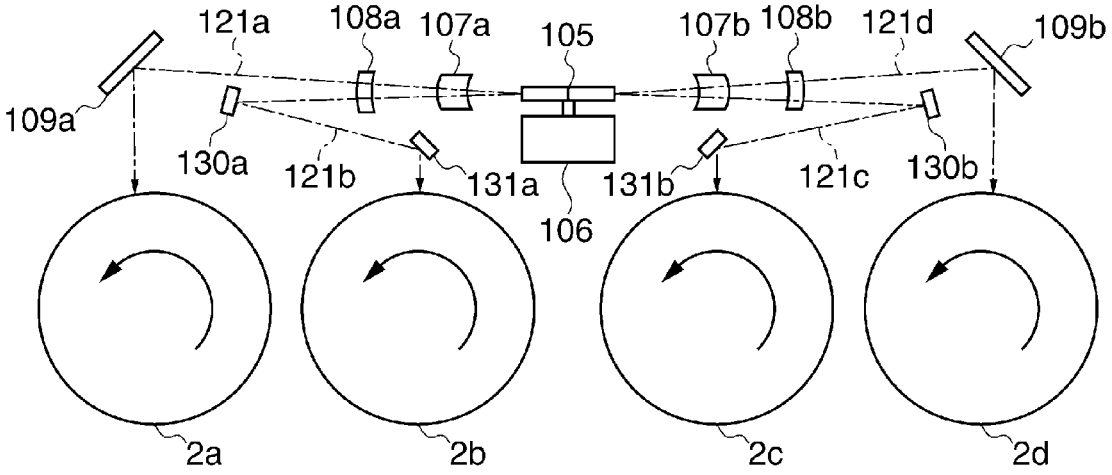
FIG. 9B is a front view showing the laser scan unit shown in FIG. 9A.
Figure 9C:
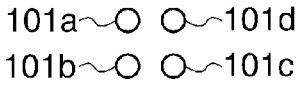
FIG. 9C is a view showing arrangement of four LDs in the laser scan unit shown in FIG. 9A.

FIG. 9A is a plan view schematically showing a configuration of a laser scan unit 100A with which the image forming apparatus according to the second embodiment is provided. FIG. 9B is a front view showing the laser scan unit 100A. FIG. 9C is a view showing arrangement of four light sources 101*a* through 101*d* in the laser scan unit 100A. It should be noted that identical reference numerals are given to constructional elements in FIG. 9A and FIG. 9B that are identical to constructional elements in FIG. 2A and FIG. 2B, and their descriptions are omitted suitably.

As shown in FIG. 9A, the laser scan unit 100A is provided with a housing in which constructional elements are arranged, and has the four light sources 101*a*, 101*b*, 101*c*, and 101*d*. FIG. 9A seems to have only two light sources like FIG. 2A. However, as shown in FIG. 9C, the light source 101*b* is arranged just under the light source 101*a*, and the light source 101*c* is similarly arranged just under the light source 101*d*. Accordingly, the laser scan unit 100A forms electrostatic latent images corresponding to four colors of Y, M, C, and K, on photosensitive drums 2*a* through 2*d* using the four light sources 101*a* through 101*d*, respectively. The light source 101*d* functions as a first light source in the second embodiment, and the light source 101*a* functions as a second light source in the second embodiment. Moreover, the light source 101*c* functions as a third light source in the second embodiment, and the light source 101*b* functions as a fourth light source in the second embodiment.

The laser beams emitted from the light sources 101*a* and 101*b* in the Y- and M-stations pass through collimating lenses 102*a* and 102*b*, and are converted into parallel beams. Then, the laser beams pass through aperture diaphragms 103*a* and 103*b*, and the beam diameters are restricted. Furthermore, the laser beams pass through cylindrical lenses 104*a* and 104*b*, and form elliptical images that are long in the principal scanning direction on a reflective surface of a polygon mirror 105. The light source 101*a* for a Y-image and the light source 101*b* for an M-image are installed in different positions in a height direction. In the second embodiment, laser beams 120*a* and 120*b* impinge on the polygon mirror 105 along optical paths that are slant to the axial direction of the rotating shaft of the polygon mirror 105. Accordingly, the laser beams 120*a* and 120*b* for a Y-image and an M-image irradiate almost the same position. It should be noted that the embodiment may employ a laser scan unit configured so that laser beams impinge on the polygon mirror 105 along optical paths that are almost perpendicular to the axial direction of the rotating shaft of the polygon mirror 105. The polygon mirror 105 is rotated by the scanner motor 106 at constant speed in the arrow direction in FIG. 9A, and deflects the laser beams so that the laser beams that impinge on the reflective surfaces scan the respective photosensitive drums. In FIG. 9A, the laser beams for a Y-image and an M-image are scanned at the left side, and the laser beams for a C-image and a K-image are scanned at the right side.

The optical systems for a Y-image and an M-image will be described first.

When the laser beams 120*a* and 120*b* from the light sources 101*a* and 101*b* are incident on the reflective surface of the polygon mirror 105 at an angle of 45 degrees, the laser beams are reflected at 90 degrees with respect to the incident beams. The laser beams 121*a* and 121*b* reflected at 90 degrees pass through a common toric lens 107*a* and a common diffraction optical element 108*a*. Then, as shown in FIG. 9B, the laser beam 121*a* for a Y-image is reflected by a folding mirror 109*a*, and finally irradiates the photosensitive drum 2*a*. On the other hand, the laser beam 121*b* for an M-image is reflected by a first folding mirror 130*a* and then is reflected by a second folding mirror 131*a*, and irradiates the photosensitive drum 2*b*. Although the laser beams for a Y-image and an M-image irradiate the different photosensitive drums 2*a* and 2*b*, respectively, they scan almost the same position in the principal scanning direction.

The laser beam deflected by the polygon mirror 105 also enters a BD 114. The laser beam 122*b* that is deflected by the polygon mirror 105 and enters the BD 114 is not a laser beam for a Y-image or an M-image, but is one of a laser beam 120*c* for a C-image and a laser beam 120*d* for a K-image. The BD 114, which is a signal generation unit, has the same configuration and the same function as the BD 114 in FIG. 2, and outputs a BD signal based on the incident laser beam 122*b*. Formations of a Y-image and an M-image start in a predetermined period from an output timing of the BD signal that the BD 114 generates by detecting the laser beam 120*c* for a C-image or the laser beam 120*d* for a K-image (the laser beam 120*d* for a K-image is used in the second embodiment) as mentioned later.

In the second embodiment, the APC mode in each of below-mentioned laser drivers is also switched at predetermined time intervals within one scan based on the BD signal. This is because the laser beams scan symmetrically as with the relationship between the laser beam for a Y-image and the laser beam for an M-image in the above-mentioned first embodiment, when the polygon mirror 105 with four reflective surfaces is employed. Since the image formation start timing may be affected with variation in the accuracy of the reflective surface of the polygon mirror 105, the image formation starts after correcting the detection timing of the BD signal according to an individual difference of the polygon mirror 105. On the other hand, since the switching timing of the operation mode of each of the laser drivers can permit some errors, the laser beam for a Y-image and the laser beam for an M-image are driven at the same timing.

The optical systems for a C-image and a K-image will be described next.

The laser beams 120*c* and 120*d* emitted from the light sources 101*c* and 101*d* for a C-image and a K-image pass through collimating lenses 102*c* and 102*d*, and are converted into parallel beams. Then, the laser beams pass through aperture diaphragms 103*c* and 103*d*, and the beam diameters are restricted. Furthermore, the laser beams pass through cylindrical lenses 104*c* and 104*d*, and form elliptical images that are long in the principal scanning direction on a reflective surface of a polygon mirror 105. The light source 101*c* for a C-image and the light source 101*d* for a K-image are installed in different positions in a height direction. The laser beams 120*c* and 120*d* are incident on the polygon mirror 105 along optical paths that are slant to the axial direction of the rotating shaft of the polygon mirror 105. Accordingly, the laser beams 120*c* and 120*d* for a C-image and a K-image irradiate almost the same position.

The polygon mirror 105 is rotated by the scanner motor 106 at constant speed in the arrow direction in FIG. 9A, and deflects the laser beams so that the laser beams that are incident on the reflective surfaces scan the respective photosensitive drums. In FIG. 9A, the laser beams for a Y-image and an M-image are scanned at the left side, and the laser beams for a C-image and a K-image are scanned at the right side. The positions at which the laser beams emitted from the light sources 101*c* and 101*d* and reflected at 90 degrees reach are the centers of the photosensitive drums 2*c* and 2*d* in the principal scanning direction, and the positions shall be coincident with image centers. When the laser beams 120*c* and 120*d* from the light sources 101*c* and 101*d* are incident on the reflective surface of the polygon mirror 105 at an angle of 45 degrees, the laser beams are reflected at 90 degrees with respect to the incident beams. The laser beams 121*a* and 121*b* reflected at 90 degrees pass through a common toric lens 107*b* and a common diffraction optical element 108*b*. Then, as shown in FIG. 9B, the laser beam 121*d* for a K-image is reflected by a folding mirror 109*b*, and, finally irradiates the photosensitive drum 2*d*. On the other hand, the laser beam 121*c* for a C-image is reflected by a first folding mirror 130*b* and then is reflected by a second folding mirror 131*b*, and irradiates the photosensitive drum 2*c*. Although the laser beams for a C-image and a K-image irradiate the different photosensitive drums 2*a* and 2*b*, respectively, they scan almost the same position in the principal scanning direction.

Since the scanning timings of the laser beams in the Y-, M-, C-, and K-stations are identical, the switching timings to the APC mode may be common to the Y-, M-, C-, and K-stations.

In the second embodiment, the optical path of the laser beam 120*d* and the optical path of the laser beam 120*a* are approximately parallel to the virtual plane containing the rotating axis of the polygon mirror 105. The laser beam 120*a* is incident on the reflective surface that adjoins the reflective surface on which the laser beam 120*a* is incident at the upstream side in the rotating direction of the polygon mirror 105. Moreover, the light sources 101*a* through 101*d* and the polygon mirror 105 are arranged so that the laser beam 120*c* is incident on the same reflective surface on which the laser beam 120*d* is incident, and so that the laser beam 120*b* is incident on the same reflective surface on which the laser beam 120*a* is incident.

Figure 10:
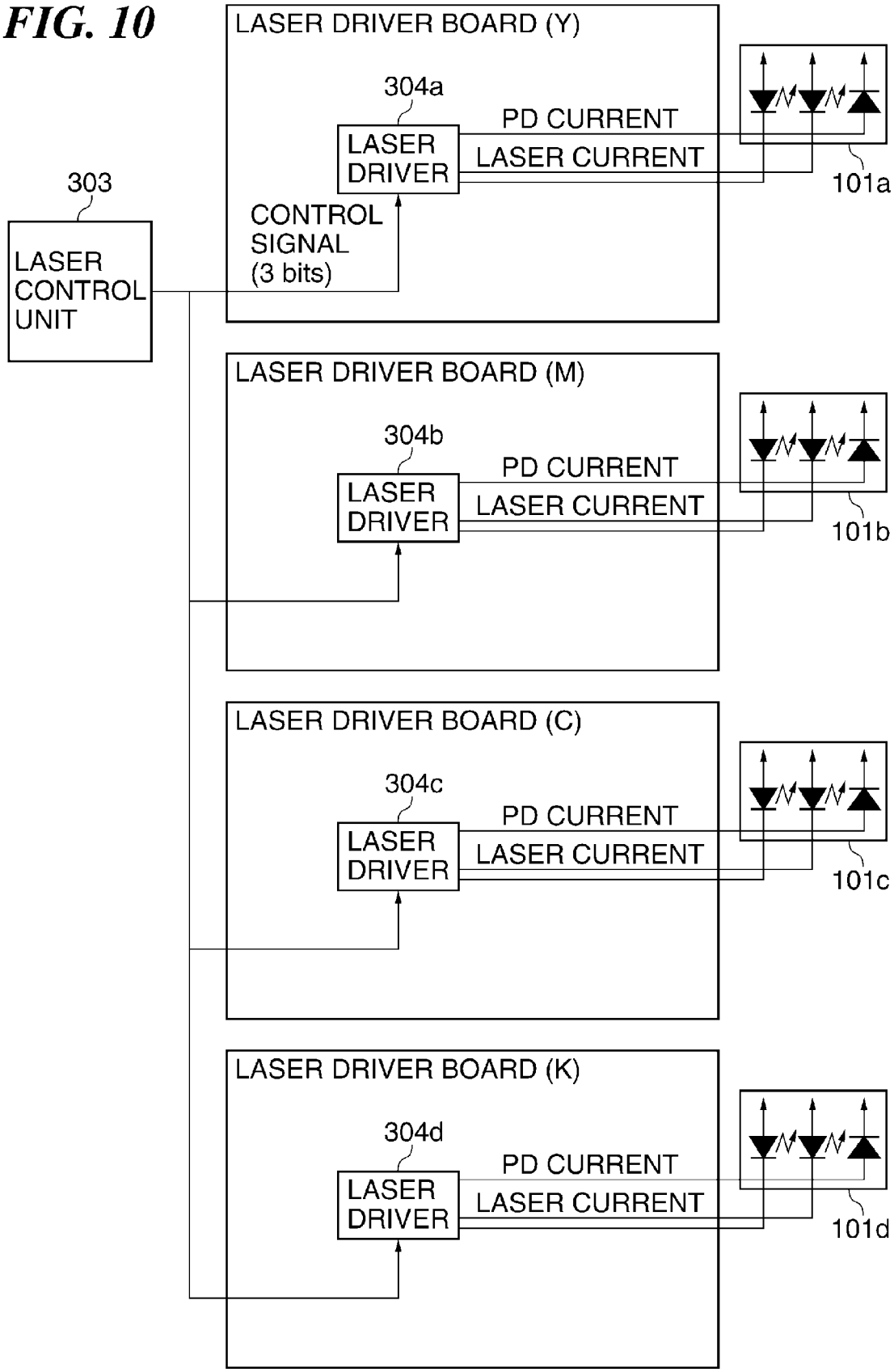
FIG. 10 is a block diagram schematically showing a connection configuration between a laser control unit and laser drivers of Y-, M-, C-, and K-stations according to the second embodiment.

FIG. 10 is a block diagram schematically showing a connection configuration between a laser control unit and laser drivers of Y-, M-, C-, and K-stations according to the second embodiment.

As shown in FIG. 10, the laser driver 304*a* is connected with the laser control unit 303 through a wiring for transferring an operation mode signal. Moreover, the wiring for transferring the operation mode signal branches on the way, and the branched wirings for transferring the operation mode signal are connected to the laser drivers 304*b*, 304*c*, and 304*d*, respectively. The laser control unit 303 outputs a common control signal (3 bits) to the Y-, M-, C-, and K-stations, and this control signal (3 bits) is distributed to laser driver boards of the Y-, M-, C-, and K-stations.

Figure 11:
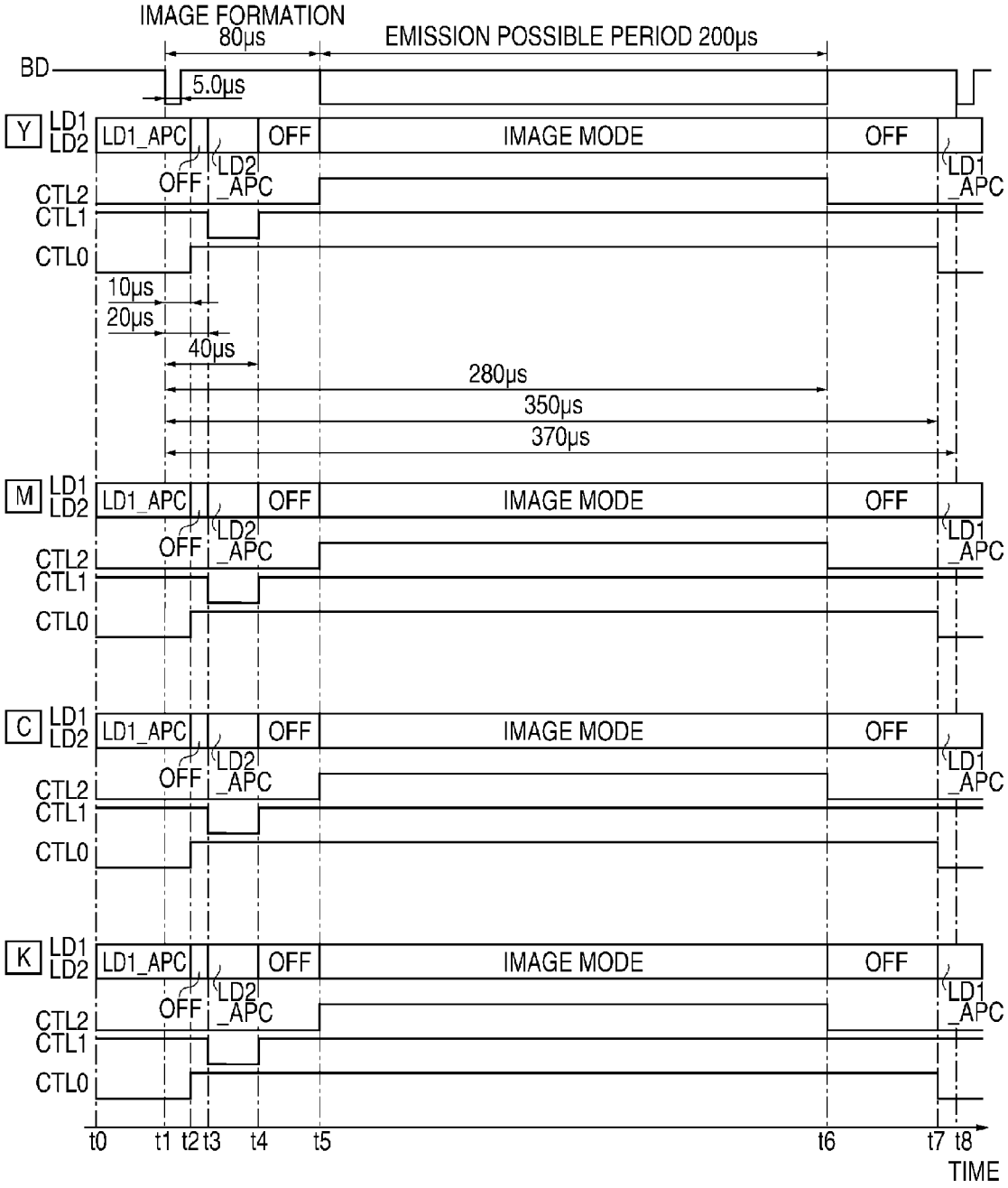
FIG. 11 is a timing chart showing timings at which the laser drivers of the Y-, M-, C-, and K-stations shown in FIG. 10 change operation modes.

FIG. 11 is a timing chart showing timings at which the laser drivers of the Y-, M-, C-, and K-stations shown in FIG. 10 change the operation modes.

The switching timings for the operation modes in the timing chart in FIG. 11 are identical to that in the timing chart in FIG. 8 mentioned above. Accordingly, the description about the timing chart in FIG. 11 is omitted.

Moreover, since the switching timings of the operation modes are common for all the laser drivers in FIG. 11, one control table as shown in FIG. 6 used for the switching control is shared by the laser drivers of the Y-, M-, C-, and K-stations. That is, four laser drivers corresponding to four light sources are controlled using one control table.

Since the second embodiment employs one control table for four optical systems of which the switching timings are identical and controls the laser drivers corresponding to the four light sources with one control table, the number of the signal lines for transmitting the control signals is further reducible than the first embodiment.

Figure 12:
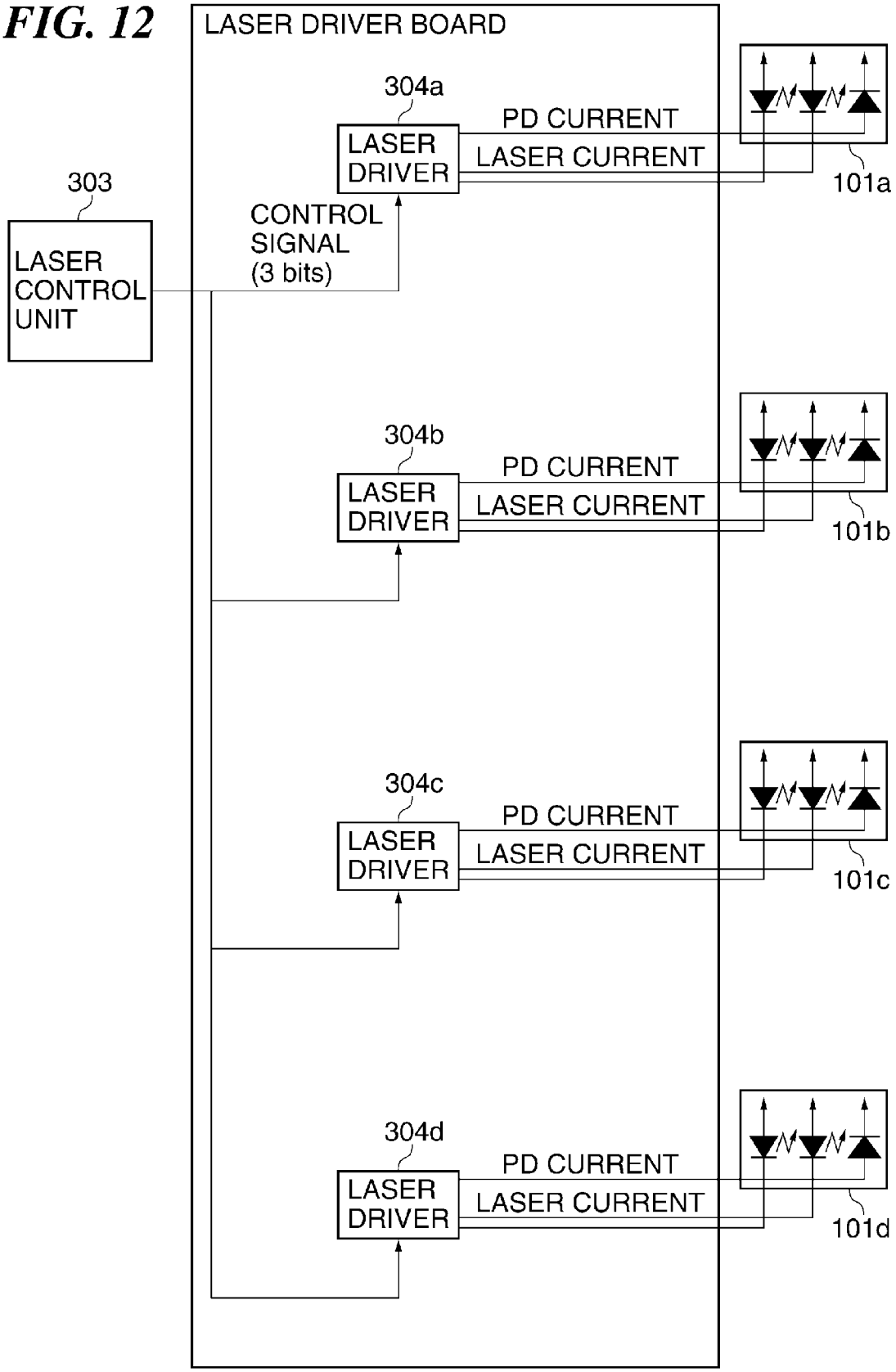
FIG. 12 is a view showing a modification of the connection configuration shown in FIG. 10.

FIG. 12 is a view showing a modification of the connection configuration shown in FIG. 10.

As shown in FIG. 12, laser drivers 304*a* through 304*d* for a Y-image, an M-image, a C-image, and a K-image are provided on one substrate, and wirings inside the substrate are configured to distribute a control signal (3 bits) to the respective laser drivers 304*a* through 304*d*.

Generally, an LD is mounted on a laser driver board, and the laser driver board is attached to the laser scan unit. Moreover, the laser control unit is installed together with the drive control unit for the color printer body, etc., and is separated from the laser driver board. Accordingly, the laser control unit must transmit a control signal, an image signal, etc. through electric wires with the laser driver board.

Since the modification shown in FIG. 12 arranges the laser drivers 304*a* through 304*d* for a Y-image, an M-image, a C-image, and a K-image on one substrate, the number of the signal lines for transmitting the control signal (3 bits) is reducible to one fourth.

Next, a third embodiment of the present invention will be described. A color printer of the third embodiment is different from the color printer of the above-mentioned second embodiment in a part of the control process that is executed by the laser control unit 303. It should be noted that the hardware configuration of the color printer according to the third embodiment is the same as the hardware configuration of the color printer according to the second embodiment.

Figure 14A:
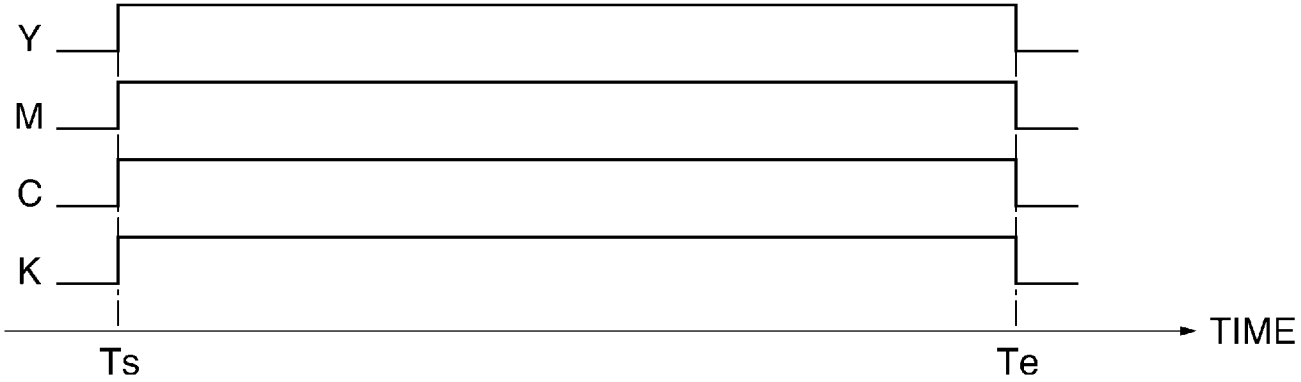
FIG. 14A is a timing chart showing lighting timings of LDs from start to end of an image formation according to the second embodiment of the present invention.

When the control signal (3 bits) is shared by all the Y-, M-, C-, and K-stations as with the above-mentioned second embodiment, the APC operations by the Y-, M-, C-, and K-stations are simultaneously started just after the start of the image formation (timing Ts) as shown in FIG. 14A, which starts the emission of the light sources simultaneously. Then, the stop timing Te of the APC operations at the end of the image formations becomes identical to all the Y-, M-, C-, and K-stations.

Figure 13:
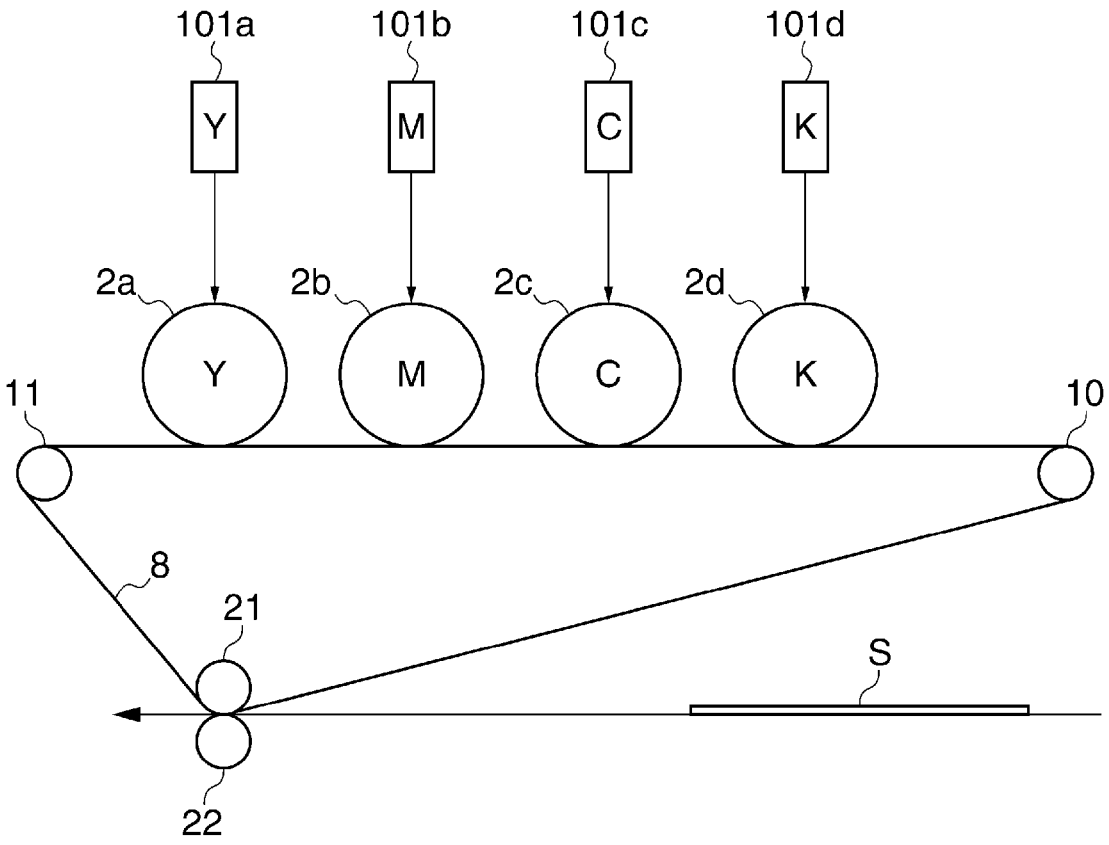
FIG. 13 is a view schematically showing an image forming operation that a color printer according to a third embodiment of the present invention executes.

FIG. 13 is a view schematically showing an image forming operation that the color printer according to the third embodiment executes.

Figure 14B:
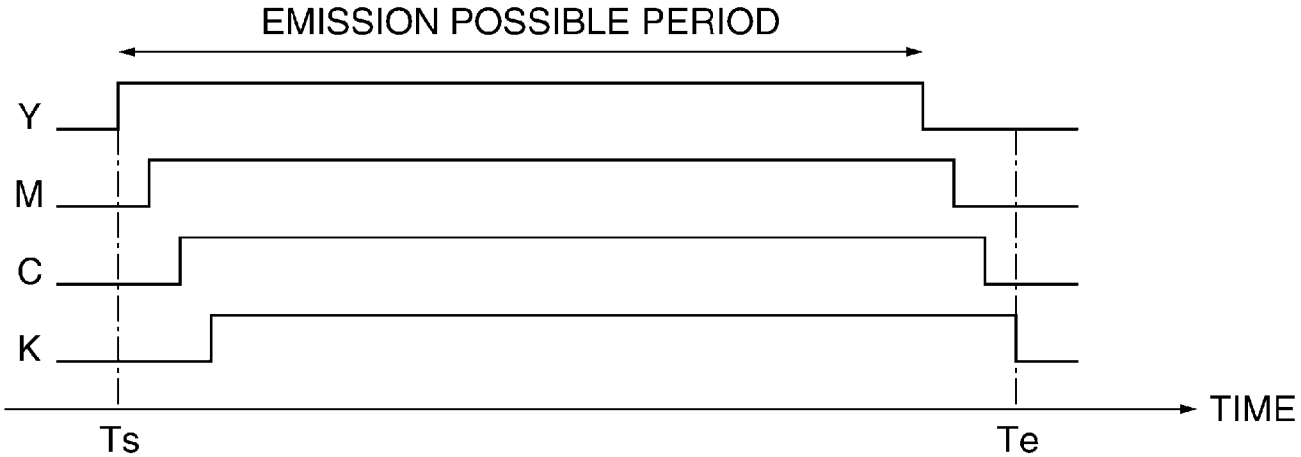
FIG. 14B is a timing chart showing lighting timings of LDs from start to end of an image formation according to the third embodiment of the present invention.

As shown in FIG. 13, the image formation to the photosensitive drum 2*a* for a Y-image begins first, when the image forming operation is started. And the image formation to the photosensitive drum 2*d* for a K-image finishes at the end, when the image forming operation is terminated. Accordingly, from a viewpoint of life of an LD, it is preferable that the emission timings of the light sources 101*a* through 101*d* are shifted in order of Y, M, C, and K at the time of the start of the image formation as shown in FIG. 14B (the lights are turned on one by one). Similarly, the APC operation for a Y-image is stopped first at the termination of the image formation, and the APC operation for a K-image is stopped immediately after the termination of print of a K-image (the lights are turned off one by one).

In this case, the timings at which the APC mode starts and terminates are the same as the timings in FIG. 11, and the laser emissions are controlled by changing the values of the light amount control signals (see FIG. 3B), which are transmitted by the laser control unit 303 to the laser drivers 304*a* through 304*d*, as shown in FIG. 14B. Specifically, the laser control unit 303 sets 0% of the light amount to the value of the light amount control signal before starting the image formation, and sets a specified value (for example, 80% of the light amount) to the light amount control signal after starting the image formation. When the value of the light amount control signal is 0% of the light amount, the laser drivers 304*a* through 304*d* do not make the light sources 101*a* through 101*d* emit light, respectively. A light amount required for printing varies according to environmental temperature, humidity, and the used amounts of the photosensitive drums 2*a* through 2*d*.

Figure 15:
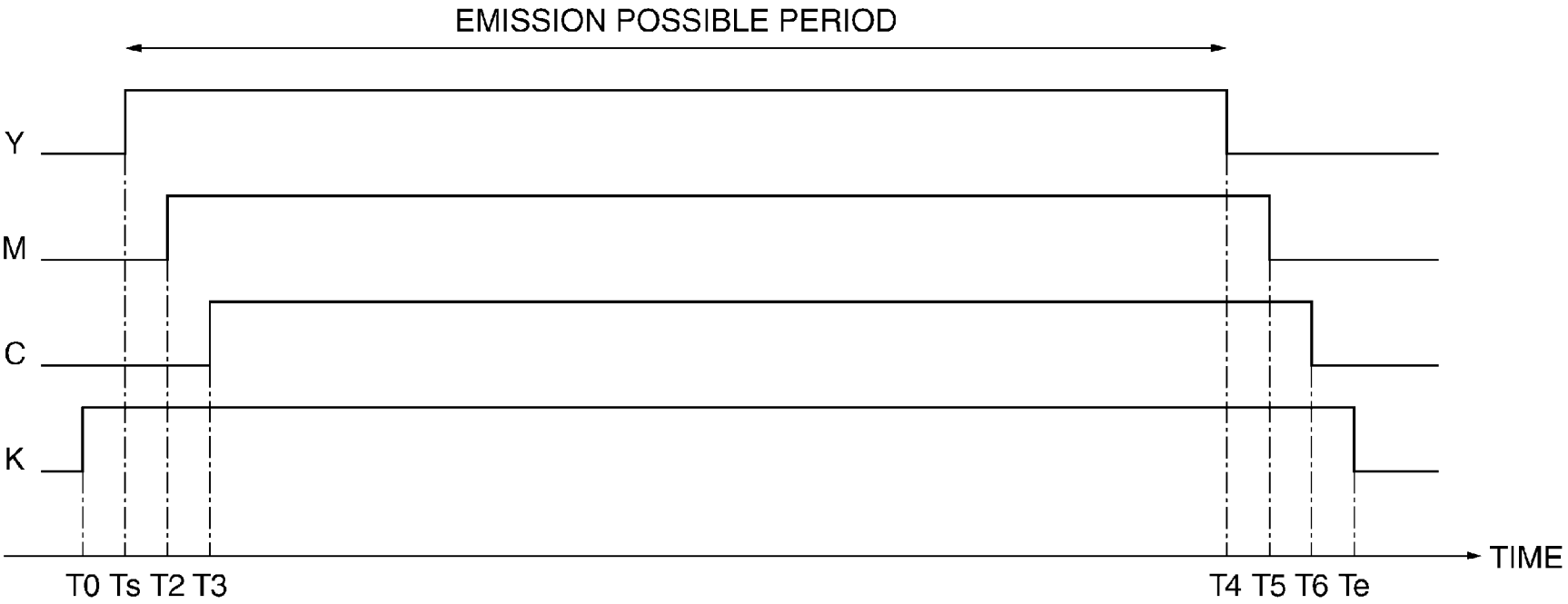
FIG. 15 is a timing chart showing an example of a laser emission control that the laser control unit of the color printer according to the third embodiment of the present invention executes.

FIG. 15 is a timing chart showing an example of a laser emission control that the laser control unit 303 of the color printer according to the third embodiment executes.

As shown in FIG. 15, the laser control unit 303 changes the value of the light amount control signal for a K-image to 80% of the light amount from 0% of the light amount first, when the image formation is started. The reason why the light source 101*d* for a K-image is turned on to emit light first is that the BD signal is detected based on the laser beam emitted from the light source 101*d* for a K-image in the laser scan unit of the color printer according to the third embodiment.

Then, the value of the light amount control signal for a Y-image to 80% of the light amount from 0% of light amount with a delay amount (timing Ts) equivalent to the printing delay that is determined by the intervals of the photosensitive drums 2*a* through 2*d* in FIG. 13. In the same manner, the values of the light amount control signals for an M-image and a C-image are changed to 80% of the light amount from 0% of light amount with the printing delays (timings T2 and T3). At the time of termination of the image formation, the laser control unit 303 changes the value of the light amount control signal to 0% of the light amount from 80% of the light amount when the printing for a Y-image is finished (timing T4). In the same manner, the values of the light amount control signals for an M-image and a C-image are changed to 0% of the light amount from 80% of the light amount immediately after finishing the printings for an M-image and a C-image, respectively (timings T5 and T6). Finally (timing Te), the laser control unit 303 changes the value of the light amount control signal for a K-image to 0% of the light amount from 80% of the light amount.

According to the third embodiment, the emission time of the light sources 101*b* through 101*c* for a Y-image, an M-image, and a C-image can be shortened with the above-mentioned control, and, thereby, the lives of the light sources 101*b* through 101*c* can be prolonged.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-122703, filed Jun. 11, 2013, which is hereby incorporated by reference herein in its entirety.

What is claimed is:

1. An image forming apparatus comprising:

a first light source;

a second light source;

a rotation polygon mirror configured to have four reflective surfaces and to deflect a light beam emitted from said first light source and a light beam emitted from said second light source with the four reflective surfaces so that the light beam emitted from said first light source scans a first photoconductor and the light beam emitted from said second light source scans a second photoconductor, said rotation polygon mirror being shaped in substantially a square when viewed along a rotation axis of said rotation polygon mirror, and the four reflective surfaces are disposed at sides of said substantially square rotation polygon mirror and arranged in parallel with the rotation axis, respectively;

a housing in which said first light source, said second light source, and said rotation polygon mirror are arranged so that an optical path of the light beam emitted from said first light source toward said rotation polygon mirror and an optical path of the light beam emitted from said second light source toward said rotation polygon mirror are parallel to a virtual plane that is parallel to a rotating axis of said rotation polygon mirror and contains the rotating axis, and so that the light beam emitted from said second light source is incident on a reflective surface among the four reflective surfaces that adjoins to the reflective surface on which the light beam emitted from said first light source is incident at an upstream side in a rotating direction of said rotation polygon mirror;

a first driver IC configured to drive said first light source in one operation mode among a plurality of operation modes;

a second driver IC configured to drive said second light source in one operation mode among the plurality of operation modes;

a control unit configured to output a same operation mode signal to both said first driver IC and said second driver IC at a same timing so that the operation mode of said first light source is identical to the operation mode of said second light source; and a first light receiving unit configured to receive a light beam emitted from said first light source, and a second light receiving unit configured to receive a light beam emitted from said second light source, wherein the plurality of operation modes include a light amount control mode, said first driver IC controls a value of a current to said first light source based on a reception result of said first light receiving unit in the light amount control mode, wherein said second driver IC controls a value of a current to said second light source based on a reception result of said second light receiving unit in the light amount control mode, and wherein the control unit outputs the same operation mode signal for changing another operation mode into the light amount control mode to both said first driver IC and said second driver IC at a same timing.

2. The image forming apparatus according to claim 1, wherein a wiring that connects said control unit with said first driver IC in order to transmit the operation mode signal from said control unit branches between said control unit and said first driver IC, and the branched wiring is connected to said second driver IC.

3. The image forming apparatus according to claim 2, further comprising:

a first board on which the first driver IC is disposed; and a second board on which the second driver IC is disposed, wherein a part of the wiring that connects said control unit with the first driver IC is disposed on said first board, wherein a part of the branched wiring is disposed on said second board, and wherein the branched wiring is branched, at a portion other than said first board and said second board, from the wiring that connects said control unit with said first driver IC.

4. The image forming apparatus according to claim 2, further comprising a board on which the first driver IC and the second driver IC are disposed, wherein a part of the wiring that connects said control unit with said first driver is disposed on the board, wherein the branched wiring is disposed on the board, and wherein the branched wiring is branched, on said board, from the wiring that connects said control unit with said first driver IC.

5. The image forming apparatus according to claim 1, further comprising a first wiring that connects said control unit to said first driver IC, and a second wiring that connects said control unit to said second driver IC, wherein said control unit transmits the operation mode signal to said first driver IC through said first wiring, and transmits the operation mode signal to said second driver IC through said second wiring.

6. The image forming apparatus according to claim 1, further comprising a signal generating unit configured to receive the light beam emitted from said second light source and to output a synchronizing signal in response to the receipt of the light beam concerned, wherein said control unit changes the operation mode signal transmitted to said first driver IC and said second driver IC based on a generating timing of the synchronizing signal generated by said signal generating unit.

7. The image forming apparatus according to claim 1, wherein the light beam emitted from said second light source and the light beam emitted from said first light source are configured to be simultaneously incident on different reflective surfaces among the four reflective surfaces from each other.

8. The image forming apparatus according to claim 1, wherein the rotation polygon mirror is a square with four reflective surfaces.

9. The image forming apparatus according to claim 1, wherein the control unit transmits a plurality of bit data as the same operation mode signal to said first driver IC and said second driver IC.

10. An image forming apparatus comprising:

a first light source;

a second light source;

a third light source;

a fourth light source;

a rotation polygon mirror configured to have four reflective surfaces and to deflect light beams emitted from said first, second, third, and fourth light sources with the four reflective surfaces so that the light beams emitted from said first, second, third, and fourth light sources scan first, second, third, and fourth photoconductors, respectively, said rotation polygon mirror being shaped in substantially a square when viewed along a rotation axis of said rotation polygon mirror, and the four reflective surfaces are disposed at sides of said substantially square rotation polygon mirror and arranged in parallel with the rotation axis, respectively;

a housing in which said first light source, said second light source, said third light source, said fourth light source, and said rotation polygon mirror are arranged so that an optical path of the light beam emitted from said first light source toward said rotation polygon mirror and an optical path of the light beam emitted from said second light source toward said rotation polygon mirror are parallel to a virtual plane that is parallel to a rotating axis of said rotation polygon mirror and contains the rotating axis, so that the light beam emitted from said second light source is incident on a reflective surface among the four reflective surfaces that adjoins to the reflective surface on which the light beam emitted from said first light source is incident at an upstream side in a rotating direction of said rotation polygon mirror, so that the light beam emitted from said third light source is incident on the same reflective surface on which the laser beam emitted from said first light source is incident, and so that the laser beam emitted from said fourth light source is incident on the same reflective surface on which the laser beam emitted from said second light source is incident;

a first driver IC configured to drive said first light source in one operation mode among a plurality of operation modes;

a second driver IC configured to drive said second light source in one operation mode among the plurality of operation modes;

a third driver IC configured to drive said third light source one operation mode among the plurality of operation modes;

a fourth driver IC configured to drive said fourth light source in one operation mode among the plurality of operation modes;

a control unit configured to output a same operation mode signal to all said first driver IC, said second driver IC, said third driver IC, and said fourth driver IC at a same timing so that the operation mode of said first light source, the operation mode of said second light source, the operation mode of said third light source, and the operation mode of said fourth light source are identical; and a first light receiving unit configured to receive a light beam emitted from said first light source, a second light receiving unit configured to receive a light beam emitted from said second light source, a third light receiving unit configured to receive a light beam emitted from said third light source, and a fourth light receiving unit configured to receive a light beam emitted from said fourth light source, wherein the plurality of operation modes include a light amount control mode, said first driver IC controls a value of a current to said first light source based on a reception result of said first light receiving unit in the light amount control mode, wherein said second driver IC controls a value of a current to said second light source based on a reception result of said second light receiving unit in the light amount control mode, wherein said third driver IC controls a value of a current to said third light source based on a reception result of said third light receiving unit in the light amount control mode, wherein said fourth driver IC controls a value of a current to said fourth light source based on a reception result of said fourth light receiving unit in the light amount control mode, and wherein the control unit outputs a same operation mode signal for changing another operation mode into the light amount control mode to said first driver IC, said second driver IC, said third driver IC, and said fourth driver IC at a same timing.

11. The image forming apparatus according to claim 10, wherein a wiring that connects said control unit with said first driver IC in order to transmit the operation mode signal from said control unit branches between said control unit and said first driver IC, and the branched wirings are connected to said second driver IC, said third driver IC, and said fourth driver IC.

12. The image forming apparatus according to claim 11, further comprising:

a first board on which the first driver IC is disposed;

a second board on which the second driver IC is disposed;

a third board on which the third driver IC is disposed; and a fourth board on which the fourth driver IC is disposed, wherein a part of the wiring that connects said control unit with said first driver IC is disposed on said first board, and wherein parts of the branched wirings are disposed on said first board, said second board, said third board, and said fourth board, respectively, and wherein parts of the branched wirings are branched, at portion other than said first board, said second board, said third board, and said fourth board, from the wiring that connects said control unit with said first driver IC.

13. The image forming apparatus according to claim 11, further comprising a board on which the first driver IC, the second driver IC, the third driver IC, and the fourth driver IC are disposed, wherein a part of the wiring that connects said control unit with said first driver IC is disposed on said board, wherein the branched wirings are disposed on said board, and wherein the branched wirings are branched from the wiring that connects said control unit with said first driver IC.

14. The image forming apparatus according to claim 10, further comprising a first wiring that connects said control unit to said first driver IC, a second wiring that connects said control unit to said second driver IC, a third wiring that connects said control unit to said third driver IC, and a fourth wiring that connects said control unit to said fourth driver IC, and wherein said control unit transmits the operation mode signal to said first driver IC through said first wiring, transmits the operation mode signal to said second driver IC through said second wiring, transmits the operation mode signal to said third driver IC through said third wiring, and transmits the operation mode signal to said fourth driver IC through said fourth wiring.

15. The image forming apparatus according to claim 10, further comprising a signal generating unit configured to receive the light beam emitted from said second light source and to output a synchronizing signal in response to the receipt of the light beam concerned, wherein said control unit changes the operation mode signal transmitted to said first driver IC, said second driver IC, said third driver IC, and said fourth driver IC based on a generating timing of the synchronizing signal generated by said signal generating unit.

16. The image forming apparatus according to claim 10, wherein the control unit transmits a plurality of bit data as the same operation mode signal to said first driver IC, said second driver IC, said third driver IC, and said fourth driver IC.

17. An image forming apparatus comprising:

a first light source;

a second light source;

a rotation polygon mirror configured to have four reflective surfaces and to deflect a light beam emitted from said first light source and a light beam emitted from said second light source with the four reflective surfaces so that the light beam emitted from said first light source scans a first photoconductor and the light beam emitted from said second light source scans a second photoconductor;

a housing in which said first light source, said second light source, and said rotation polygon mirror are arranged so that an optical path of the light beam emitted from said first light source toward said rotation polygon mirror and an optical path of the light beam emitted from said second light source toward said rotation polygon mirror are parallel to a virtual plane that is parallel to a rotating axis of said rotation polygon mirror and contains the rotating axis, and so that the light beam emitted from said second light source is incident on a reflective surface among the four reflective surfaces that adjoins to the reflective surface on which the light beam emitted from said first light source is incident at an upstream side in a rotating direction of said rotation polygon mirror;

a first driver IC configured to drive said first light source in one operation mode among a plurality of operation modes;

a second driver IC configured to drive said second light source in one operation mode among the plurality of operation modes; and a control unit configured to output a same operation mode signal to both said first driver IC and said second driver IC at a same timing so that the operation mode of said first light source is identical to the operation mode of said second light source, wherein the plurality of operation modes include an enable mode that allows emission of the light beam and an disable mode that does not allow emission of the light beam, wherein said control unit transmits either of an enable signal for driving said light sources in the enable mode and a disable signal for driving said light sources in the disable mode as the operation mode signal to said driver ICs.

18. The image forming apparatus according to claim 17, wherein said control unit outputs the enable signal to said driver ICs at a timing based on the synchronizing signal in order to allow said light sources to emit the light beams in a period during which the light beams emitted from said light sources scan electrostatic latent image formation areas on corresponding photoconductors, respectively.

19. The image forming apparatus according to claim 18, wherein each of said light sources is provided with a photo detector that receives the light beam emitted from the corresponding light source, wherein each of said driver ICs performs a light amount control that controls the light amount of the light beam emitted from the corresponding light source based on a light receiving result of the photo detector with which the corresponding light source is provided, and wherein said control unit outputs the enable signal to said driver ICs at a timing based on the synchronizing signal in order to perform the light amount control at a timing other than the period during which the light beams emitted from said light sources scan the electrostatic latent image formation areas on the corresponding photoconductors, respectively.

20. The image forming apparatus according to claim 19, wherein said control unit outputs the disable signal after outputting the enable signal for performing the light amount control.

21. The image forming apparatus according to claim 19, wherein each of said light sources is provided with a plurality of light emission points of the same number, and wherein said control unit outputs the enable signal multiple times so that the light amount control is performed for every emission point at a timing other than the period during which the light beams emitted from said light sources scan the electrostatic latent image formation areas, and outputs the disable signal after outputting the enable signal multiple times for performing the light amount control.

* * * * *